US010219553B2

(12) United States Patent
Curran

(10) Patent No.: US 10,219,553 B2
(45) Date of Patent: Mar. 5, 2019

(54) SYSTEM AND METHOD OF ADJUSTING THE FIT OF CLOTHING

(71) Applicant: 11 Pine, Inc., Boulder, CO (US)

(72) Inventor: David Jeffrey Curran, Boulder, CO (US)

(73) Assignee: 11 Pine, Inc., Boulder, CO (US)

( * ) Notice: Subject to any disclaimer, the term of this patent is extended or adjusted under 35 U.S.C. 154(b) by 643 days.

(21) Appl. No.: 14/873,367

(22) Filed: Oct. 2, 2015

(65) Prior Publication Data

US 2016/0095367 A1 Apr. 7, 2016

Related U.S. Application Data

(63) Continuation-in-part of application No. 29/504,333, filed on Oct. 3, 2014.

(60) Provisional application No. 62/059,744, filed on Oct. 3, 2014.

(51) Int. Cl.

| | |
|---|---|
| ***A41D 1/08*** | (2018.01) |
| ***A41D 1/084*** | (2018.01) |
| ***A41D 27/28*** | (2006.01) |

(52) U.S. Cl.

CPC ..... *A41D 1/084* (2013.01); *A41D 27/285* (2013.01); *A41D 2400/24* (2013.01); *A41D 2400/38* (2013.01)

(58) Field of Classification Search

CPC .. A41D 1/084; A41D 27/285; A41D 2400/24; A41D 2400/38

See application file for complete search history.

(56) References Cited

U.S. PATENT DOCUMENTS

| | | | | | |
|---|---|---|---|---|---|
| RE9,038 | E | * | 1/1880 | Spies | 2/237 |
| 752,769 | A | * | 2/1904 | Graichen | A41D 19/0044 2/162 |
| 841,824 | A | * | 1/1907 | Sweet | A41D 1/06 2/227 |
| 1,641,487 | A | * | 9/1927 | Hockmeyer | A41D 1/06 2/227 |
| 1,691,057 | A | * | 11/1928 | Greilich | A41D 11/00 2/227 |

(Continued)

FOREIGN PATENT DOCUMENTS

WO WO 2013/141479 9/2013

OTHER PUBLICATIONS

Official Action for U.S. Appl. No. 29/546,206, dated Jun. 16, 2016 6 pages.

(Continued)

*Primary Examiner* — Richale Quinn
(74) *Attorney, Agent, or Firm* — Talus Law Group LLC

(57) ABSTRACT

A system for adjusting the fit of an article of clothing and to provide other benefits including, but not limited to, reduction and/or elimination of wind drag, reduction of loose clothing that can get caught or cause obstruction, regulation of blood circulation, movement, and swelling of the wearer of the article of clothing, adjustment of ventilation, general enhancement of the clothing for a desired activity, and general comfort and/or desired appearance. The system comprises one or more closures at various locations of the article of clothing to enable the wearer to adjust the fit of the clothing when desired.

16 Claims, 17 Drawing Sheets

(56) References Cited

U.S. PATENT DOCUMENTS 1,709,508 A * 4/1929 Weiner ..... A41F 9/025 2/237
1,861,383 A * 5/1932 Ficcio ..... A41D 1/06 2/227
1,861,704 A * 6/1932 Manke ..... A41D 1/06 2/227
1,896,183 A * 2/1933 Manson ..... A41H 41/00 2/227
2,020,984 A * 11/1935 Abelson ..... A41D 1/082 2/227
2,236,636 A * 4/1941 Young ..... A41D 1/06 2/227
2,269,380 A * 1/1942 Plimpton ..... A41D 13/02 2/227
2,317,768 A * 4/1943 Holland ..... A41D 1/06 2/227
2,349,974 A * 5/1944 McMasters ..... A41D 1/06 2/227
2,391,535 A * 12/1945 Zelano ..... A41D 27/28 2/227
2,714,720 A * 8/1955 Turner, Jr. ..... A41D 1/06 2/227
2,967,308 A * 1/1961 Freese, Jr. ..... A41D 1/082 2/227
2,971,200 A * 2/1961 Boyd ..... A41H 37/003 2/128
3,110,903 A * 11/1963 Burchard ..... A41D 1/08 2/211
3,945,051 A 3/1976 Burkard
D266,540 S 10/1982 Nacinovich
4,364,124 A * 12/1982 Barna ..... A41H 37/003 2/234
4,494,248 A * 1/1985 Holder ..... A41D 13/1245 2/114
4,667,344 A * 5/1987 Cooper, III ..... A41D 3/04 2/227
4,683,595 A * 8/1987 Cash ..... A41D 15/00 2/105
4,803,740 A * 2/1989 Dawson ..... A41D 1/21 2/215
4,805,243 A 2/1989 Gibbens et al.
4,817,211 A * 4/1989 Grilliot ..... A41D 1/067 2/227
4,868,927 A * 9/1989 Bourdeau ..... A41F 1/06 2/158
4,961,233 A 10/1990 Black
D313,692 S 1/1991 Karn
5,035,007 A * 7/1991 Grilliot ..... A41D 1/06 2/227
5,201,074 A 4/1993 Dicker
5,271,101 A 12/1993 Speth et al.
D360,516 S 7/1995 Persinger
5,598,586 A 2/1997 Munjone
5,636,380 A 6/1997 Schindler et al.
5,689,836 A 11/1997 Fee et al.
D403,487 S 1/1999 Crupi et al.
D404,185 S 1/1999 Lanter et al.
5,918,310 A 7/1999 Farahany
D427,750 S 7/2000 Fujii et al.
6,115,850 A * 9/2000 Grilliot ..... A62B 17/001 2/457
6,161,222 A 12/2000 Strickland et al.
6,363,538 B1 4/2002 Davis
6,374,414 B1 * 4/2002 Collier ..... A41D 27/10 2/69
6,611,964 B2 * 9/2003 Lipsett ..... A41D 1/06 2/227
6,684,410 B2 2/2004 Robinett et al.
D487,609 S 3/2004 Cruz
6,789,270 B1 9/2004 Pedrick
6,918,140 B1 7/2005 Cooper
D515,282 S 2/2006 Africa et al.
D518,277 S 4/2006 Collier
D525,765 S 8/2006 Arensdorf
7,231,671 B2 * 6/2007 Allen ..... A41D 1/06 2/227
D546,029 S 7/2007 Rindle
7,516,499 B2 * 4/2009 Gardner, III ..... A41D 1/21 2/221
D591,928 S 5/2009 Kirsch et al.
D597,281 S 8/2009 Young
7,631,366 B2 12/2009 Oyama et al.
7,707,651 B2 * 5/2010 White ..... A41D 1/20 2/108
7,832,022 B1 * 11/2010 Peters ..... A41D 27/28 2/227
7,941,871 B1 5/2011 Jorgensen
D661,464 S 6/2012 Wilson
D663,102 S 7/2012 Hogg
D674,166 S 1/2013 Wilson
D701,676 S 4/2014 Savage
D711,626 S 8/2014 Savage
D714,523 S 10/2014 Stinson et al.
2006/0185065 A1 8/2006 Allen
2007/0028364 A1 * 2/2007 Oomae ..... A41F 9/025 2/237
2013/0254969 A1 10/2013 Getzen et al.

OTHER PUBLICATIONS

U.S. Appl. No. 29/504,333, filed Oct. 3, 2014, Curran.
U.S. Appl. No. 14/873,367, filed Oct. 2, 2015, Curran.
Official Action for Canadian Patent Application No. 161811, dated Jul. 24, 2015, 1 page.
Notice of Allowance for U.S. Appl. No. 29/504,333, dated Sep. 15, 2015, 7 pages.
International Search Report and Written Opinion for International (PCT) Patent Application No. PCT/US2015/053652, dated Feb. 2, 2016 12 pages.
Extended European Search report for PCT/US2015/053652 (15846660.7-1017 / 3190910) dated Aug. 3, 2018; attached, 7 pages.

* cited by examiner

SYSTEM AND METHOD OF ADJUSTING THE FIT OF CLOTHING

CROSS-REFERENCE TO RELATED APPLICATIONS

This application is a continuation-in-part of U.S. patent application Ser. No. 29/504,333, filed Oct. 3, 2014, and claims the benefit of priority under 35 U.S.C. § 119(e) to U.S. Provisional Patent Application Ser. No. 62/059,744, filed Oct. 3, 2014. The entire contents of each of the foregoing applications are incorporated herein by reference.

FIELD OF THE INVENTION

The present invention relates to a system and method of adjusting the fit of clothing. More specifically, the present invention relates to clothing that includes a system adapted to vary the fit of the clothing for different activities, needs, desires, and/or moods of the wearer.

BACKGROUND

There is a growing need for clothing with a fit that can be selectively adjusted by the wearer for various activities, needs, desires, and/or moods. Currently, clothing is produced with a fit adapted for a particular activity, desire, need and/or mood. For many activities and in daily life, individuals wear clothing that is designed to be tight fitting or loose fitting with no option for the wearer to adjust the fit of the clothing according to desire, activity, and/or need. Existing clothing does not provide the wearer the option to adjust the clothing from form fitting when necessary or desired to loose fitting, or to an intermediate fit when necessary or desired. This creates a number of disadvantages as clothing that is designed for one activity may have a fit that is inappropriate, uncomfortable, unnecessary, unsuitable, or too restrictive throughout the duration of the activity, for other activities, or for the need or mood of the wearer in general.

For example, bicyclists often wear specially adapted shorts that are tight and form fitting to decrease wind drag and to provide other benefits. Although bike shorts may be suitable when biking, the tight, form fit of the bike shorts may not be necessary, desirable, comfortable, or healthy when the wearer is not biking. However, at certain times, such as when socializing, in public environments, and/or participating in other athletic activities, tight fitting shorts and/or garments may not be desired or needed, even when biking. In contrast, other types of clothes may be intentionally loose fitting for certain activities but immodest or entangling in other situations. For example, walking shorts generally have a loose hem for ventilation and comfort, but the loose hem may not provide adequate privacy when the individual is seated. The loose hem can also entangle or interfere with movement of the wearer when cycling, performing yoga, rock climbing, swimming, running, dancing or undertaking other activities. Because of this, individuals frequently must choose between purchasing and carrying extra clothes to change into after completing an activity or, unfortunately, remaining in clothing not suited for a second activity. For example, after completing an activity, such as cycling, the individual can either change clothes or remain in tight, form fitting clothing, which is uncomfortable for the wearer and for the public in general. If the individual starts with a causal activity and the second activity is more active and suited for clothing with a tighter fit, the individual must again change clothes or participate in the second activity while remaining in undesirably loose fitting clothing. To adjust loose clothing, some individuals may be compelled to use external straps to gather in loose material. For example, individuals who ride bicycles are known to place straps around the open hems of their shorts and/or pants legs to prevent the hems from become entangled with the bicycle chain and to decrease wind resistance.

Accordingly, there is an unmet need for a system and method to adjust the fit of clothing at one or more locations from a first fit to a second fit and intermediate fits between the first and second fits.

SUMMARY OF THE INVENTION

The present invention contemplates a novel system and method of selectively adjusting the fit at one or more locations of clothing of any type or style.

One aspect of the present invention is to provide a system for selectively adjusting a fit of an article of clothing. The system includes, but is not limited to: (1) a closure interconnected to a first portion and a second portion of the article of clothing; and (2) a third portion of the article of clothing positioned between the first and second portions. When the closure is in an open position, the system is in a first configuration and the third portion maintains a spaced relationship between the first and second portions. When the closure is in a closed position, the system is in a second configuration. At least a portion of the article of clothing has a tighter fit in the second configuration than in the first configuration. In one embodiment, the article of clothing has a tighter fit in the second configuration along at least the length of the closure.

Optionally, in one embodiment, the system may include at least one holding system adapted to releasably secure a chamois pad or removable chamois pad within an interior of the article of clothing. In another embodiment, a chamois pad is interconnected to an interior portion of the article of clothing. In still another embodiment of the present invention, the article of clothing further includes a liner. The liner is adapted to be worn beneath the article of clothing. Panels of fabric are position on the liner to at least partially align with the system. Accordingly, the liner may comprise a fabric panel that at least partially aligns with the third portion of the article of clothing when the system is in one of the first and second configurations. The liner may be adapted to releasably secure a chamois pad within an interior of the liner.

The system may optionally include at least one pocket associated with the system. In one embodiment, the pocket is accessible when the system is in one of the first and second configurations. The pocket may be accessible or inaccessible when the system is in the other of the first and second configurations.

In one embodiment, in the first configuration of the system, a circumference of at least a portion the article of clothing has a first dimension and the article of clothing has a loose fit. In the second configuration of the system, the circumference of the at least a portion of the article of clothing has a second dimension that is less than the first dimension and the article of clothing has a tighter fit.

In one embodiment, a bottom portion of the third portion proximate to a bottom portion of the article of clothing is wider than an upper portion of the third portion distal to the bottom portion of the article of clothing. In one embodiment, the bottom portion of the article of clothing is a hem of a leg.

In another embodiment, in the first configuration, the third portion forms a portion of an exterior surface of the article of clothing, the exterior surface being continuous. In the second configuration, the third portion is not visible from an exterior of the article of clothing. Said another way, in the first configuration, the third portion forms an unbroken portion of the exterior surface of the article of clothing between the first portion and the second portion.

In one embodiment of the present invention, the third portion has three edges. A first edge of the third portion is interconnected to the first portion along a length of the closure. A second edge of the third portion is interconnected to the second portion along the length of closure. A third edge of the third portion is positioned between the first and second edges proximate to a bottom portion of the article of clothing. The third edge is oriented in a different direction than the first and second edges. In another embodiment, the first edge and the second edge of the third portion are of approximately the same length. The first edge of the third portion is not parallel to the second edge of the third portion. In one embodiment, the third edge has a different length than the first and second edges. In another embodiment, the third portion has a generally triangular shape.

In one embodiment, increasing the length of the third edge increases the amount of the adjustment of fit provided by the system. Said another way, a short third edge provides a first amount of adjustment of the fit of the article of clothing when the system is in the second configuration. A longer third edge provides a second amount of adjustment of the fit of the article of clothing when the system is in the second configuration, and the second amount of adjustment is greater than the first amount of adjustment. In another embodiment, as the length of the first and second edges of the third portion increase, the rate of adjustment provided as the system transitions from the first configuration to the second configuration decreases. Said another way, shorter first and second edges adjust the fit quicker than longer first and second edges.

In one embodiment, the first, second, and third portions of the article of clothing are formed without seams from one piece of fabric of the article of clothing. In another embodiment, at least one of the first portion, the second portion, and the third portion comprises a fabric panel joined by a seam to a different fabric panel of a different one of the first portion, the second portion, and the third portion. In another embodiment, the first portion is a first fabric panel, the second portion is a second fabric panel, and the third portion is a third fabric panel. The first fabric panel is interconnected to the third fabric panel by a seam and the second fabric panel is interconnected to the third fabric panel by a seam. The first, second, and third fabric panels may be cut from a single piece of fabric or from two or more different pieces of fabric.

In still another embodiment, the fabric panel of the at least one of the first portion, the second portion, and the third portion is formed of at least one of a fabric type and a fabric color that is different than a fabric type or a fabric color of the different fabric panel.

In one embodiment, a type of fabric of at least one of the first, second, and third portions is selected to change a rate of ventilation provided in the first configuration compared to the second configuration. In another embodiment, the system provides a greater amount of ventilation in the first configuration than when the system is in the second configuration.

In another embodiment, a type or color of fabric of at least one of the first, second, and third portions is selected to increase visibility of the article of clothing when the system is in one of the first and the second configurations.

In another embodiment, a type of fabric of at least one of the first, second, and third portions is selected to provide at least some water resistance or water proofing to the article of clothing when the system is in one of the first and the second configurations. Accordingly, at least one of the first, second, and third portions is formed of a water-proof or a water-resistant material.

In another embodiment, a type of fabric of at least one of the first, second, and third portions is selected to provide increased wind resistance and/or wind proofing to the article of clothing when the system is in one of the first and the second configurations. Thus, at least one of the first, second, and third portions is formed of a wind proof material.

In another embodiment, a type of fabric of at least one of the first, second, and third portions is selected to reduce and/or eliminate the odor of the article of clothing when the system is in one of the first and the second configurations.

In another embodiment, a type of fabric of at least one of the first, second, and third portions is selected to increase or decrease the buoyancy of the article of clothing when the system is in one of the first and the second configurations.

In another embodiment, a type of fabric of at least one of the first, second, and third portions is selected to alter the amount, or location of, sun protection provided by the article of clothing when the system is in one of the first and the second configurations. Accordingly, at least one of the first, second, and third portions is formed of a material that provides a different amount of protection from ultra-violet light than a different one of the first, second, and third portions.

In another embodiment, a type or color of fabric of at least one of the first, second, and third portions is selected to increase visibility of the article of clothing when the system is in one of the first and the second configurations.

The system may be used with any article of clothing. In one embodiment, the article of clothing comprises one of short legs and long legs. In another embodiment, the system is positioned in at least a portion of each leg of the article of clothing. In still another embodiment, the system is oriented in a direction that is about parallel to a length of each leg. In one embodiment, the system is positioned substantially vertically on outer lateral portions of each leg of the article of clothing. In another embodiment, the closure is oriented to close downwardly from an upper portion of the article of clothing toward a lower portion of the article of clothing.

The article of clothing can include one or more of the systems in a variety of locations. For example, the system may be positioned in an arm or sleeve, a back, a front, a waist, or a leg of the article of clothing. In one embodiment of the present invention, the system is positioned in at least one of an inner portion, an outer portion, a front portion, and a back portion of each leg of the article of clothing. In another embodiment, the system is positioned in at least one of an inner portion, an outer portion, a front portion, and a back portion of each arm of the article of clothing.

Any suitable closure may be used with the system. In one embodiment, the closure is at least one of a zipper, a double (or two-way) zipper, a hook and loop material, a tab, a magnet, a ziplock, ruching, a bungee, lacing, a Boa, a button, a snap, a draw-cord, a camlock and/or any closing, adjusting, or tightening system that may be adapted for use with clothing. In another embodiment, the closure is positioned in at least one of an arm or sleeve, a back, a front, a waist, or a leg of the article of clothing.

It is yet another aspect of the present invention to provide a method of selectively adjusting a fit of an article of clothing. The method generally comprises, but is not limited to: (1) providing an article of clothing including a system adapted to adjust the fit of the article of clothing, the system comprising a first fabric panel, a second fabric panel, a third fabric panel, and a closure; (2) moving the closure of the system to an open position to place the system in a first configuration; and (3) moving the closure of the system to a closed position to place the system in a second configuration. At least a portion of the article of clothing has a tighter fit in the second configuration than in the first configuration. In one embodiment, substantially all of the article of clothing has a tighter fit proximate to the portion of the closure in the closed position.

In one embodiment of the present invention, the third fabric panel is positioned between the first and second fabric panels. A first edge of the third fabric panel may be interconnected to the first fabric panel and a first portion of the closure. A second edge of the third fabric panel may be interconnected to the second fabric panel and a second portion of the closure.

In another embodiment, when the system is in the first configuration, the third fabric panel forms a portion of an exterior surface of the article of clothing. The exterior surface of the article of clothing formed by the third fabric panel is continuous between the first and second fabric panels without voids or gaps. When the system is in a second configuration the third fabric panel does not form a portion of the exterior surface of the article of clothing. The third fabric panel is not visible from an exterior of the article of clothing when the system is in the second configuration. In one embodiment, the system is positioned in at least one of a leg portion, a sleeve portion, a back portion, a chest portion, and a waist portion of the article of clothing. Accordingly, in the second configuration, at least one of the legs, sleeves, back, chest, and waist have a tighter fit.

In one embodiment, the first, second, and third fabric panels comprise portions of one piece of fabric. In another embodiment, at least one of the first, second, and third fabric panels is formed of a different piece of fabric than an other one of the first, second, and third fabric panels.

In one embodiment, the third fabric panel maintains a spaced relationship between the first and second fabric panels in the first configuration. In another embodiment, a continuous third edge of the third fabric panel is positioned between the first and second edges of the third fabric panel. In still another embodiment, the third edge is substantially linear. In one embodiment, the article of clothing includes at least one of a leg portion, an arm portion, a back portion, a chest portion, and a waist portion.

Another aspect of the present invention is a novel article of clothing with an adjustable fit. The article of clothing includes, but is not limited to: (1) a first fabric panel; (2) a second fabric panel; (3) a third fabric panel positioned between the first and second fabric panels with a first edge of the third fabric panel interconnected to the first fabric panel and a second edge of the third fabric panel interconnected to the second fabric panel; (4) a first portion of a closure is interconnected to a portion of the first fabric panel; and (5) a second portion of the closure is interconnected to a portion of the second fabric panel. When the first portion of the closure is separate from the second portion of the closure, the article of clothing has a first fit. When the first portion of the closure at least partially contacts the second portion of the closure, the article of clothing has a second fit that is tighter than the first fit. The third fabric panel maintains a spaced relationship between the first and second fabric panels when the first and second portions of the closure are separated from each other. In one embodiment of the present invention, when the first portion of the closure is separate from the second portion of the closure, the third fabric panel forms an unbroken portion of an exterior surface of the article of clothing.

In one embodiment, when the article of clothing has the first fit, a circumference of at least a portion the article of clothing has a first dimension. When the article of clothing has the second fit, the circumference of the at least a portion of the article of clothing has a second dimension that is less than the first dimension. In one embodiment, the circumference of the article of clothing decreases transverse to the closure along substantially the entire portion of the closure in which the first portion and second portion of the closure are interconnected.

In one embodiment, at least one of the first, second, and third fabric panels is formed of one of a different piece of fabric, a different type of fabric, and a different color of fabric compared to an other one of the first, second, and third fabric panels. In one embodiment, the third fabric panel has three edges. In another embodiment, the third fabric panel has a generally triangular shape. In still another embodiment, the first, second, and third fabric panels are located in at least one of a leg portion, a sleeve portion, a back portion, a chest portion, and a waist portion of the article of clothing. In this manner, the fit of at least one of the leg portion, the sleeve portion, the back portion, the chest portion, and the waist portion of the article of clothing may be adjusted by changing the state of the closure.

The article of clothing may be adapted for men or women of any size. In one embodiment, the article of clothing is one of a pair of shorts, a pair of pants, a shirt, a jacket, an undergarment, a swimsuit, a capri pant, a skirt, a skort, a costume, and a dress. The first, second, and third fabric panels and the closure may be positioned at any location, or more than one location, on the article of clothing.

In yet another aspect of the present invention, still another system for selectively adjusting a fit of an article of clothing is provided. The system may comprise, but is not limited to: (1) a closure with a fixed end and a free end, the fixed end interconnected to a portion of the article of clothing; and (2) a lock slidably retained on the closure. When the lock is proximate to the fixed end of the closure, the system is in a second configuration and the article of clothing has a tighter fit. The article of clothing has a second, looser fit, when the lock is proximate to the free end of the closure. In one embodiment, a portion of the article of clothing has a shorter length in the second configuration compared to the first configuration. In one embodiment, the portion with the shorter length is a leg portion. In another embodiment, the portion with the shorter length comprises an arm portion.

In one embodiment, the article of clothing comprises one a pair of shorts, a pair of pants, a jumpsuit, a skirt, dress, and a skort and the system is positioned in a leg portion of the article of clothing. In another embodiment, the system is positioned substantially vertically on an exterior portion of the leg portion of the article of clothing.

In yet another embodiment, the article of clothing comprises one a shirt, a jacket, a dress, and a jumpsuit, and the system is positioned in an arm portion of the article of clothing.

The closure may comprise a draw-cord with a fixed end interconnected to a predetermined interior portion of the article of clothing. The free end of the draw-cord may extend through an aperture in the article of clothing. In one embodiment, the aperture includes a grommet. In one embodiment, the draw-cord comprises two portions each including a free end and a fixed end. The two fixed ends are interconnected to different interior portions of the article of clothing. In one embodiment, the draw-cord comprises an elastic or stretchable material. In another embodiment, the draw-cord is substantially non-stretchable. In one embodiment, the free end of the closure is pulled upwardly to move the system to the second configuration. In another embodiment, the lock is pushed upwardly to move the system to the second configuration.

In one embodiment, the fixed end of the draw-cord is proximate to a waist portion of the article of clothing. The free end of the draw cord is proximate to a hem portion. Accordingly, in the second configuration, the system decreases a distance between the waist portion and the hem portion of the article of clothing. In one embodiment, the free end of the draw-cord is accessible from an interior of a pocket of the article of clothing.

In another embodiment, the fixed end of the draw-cord is proximate to a hem portion of the article of clothing. The free end of the draw cord is proximate to the waist portion. Accordingly, to transition the system to the second configuration, the free end of the draw-cord is pulled upwardly. In this manner, the fixed end proximate to the hem pulls the hem portion upwardly. The distance between the waist portion and the hem portion of the article of clothing is at least partially decreased.

In another embodiment, the fixed end of the draw-cord is proximate to a shoulder portion of the article of clothing. The free end of the draw-cord is proximate to a cuff portion. Thus, in the second configuration, the system decreases a distance between the shoulder portion and the cuff portion of the article of clothing.

In accordance with another aspect of the present invention, a novel system for selectively adjusting a fit of an article of clothing is provided. The system generally includes, but is not limited to a first fabric panel interconnected to a second fabric panel by a closure. A third fabric panel is positioned between the first and second fabric panels. When the closure is in an open position the system is in a first configuration. When the closure is in a closed position the system is in a second configuration. At least a portion of the article of clothing has a tighter fit in the second configuration than in the first configuration.

The system may further comprise at least one holding system adapted to releasably secure other clothing accessories within an interior of the article of clothing. In one embodiment, the holding system is adapted to releasably secure a liner for a chamois pad within the interior of the article of clothing. In another embodiment, the holding system is adapted to releasably secure a chamois pad. In still another embodiment, the article of clothing includes a chamois pad interconnected thereto. In one embodiment, the system further comprises at least one pocket that is accessible when the system is in one of the first and second configurations and that is inaccessible when the system is in the other of the first and second configurations.

In one embodiment, the closure is at least one of a zipper, a double zipper, a hook and loop material, a tab, a magnet, a ziplock, ruching, lacing, a Boa, a button, a snap, a draw-cord, a camlock, and/or any closing, adjusting or tightening system that may be adapted for use with an article of clothing.

In another embodiment, the article of clothing comprises a garment with short legs such as a pair of shorts. In yet another embodiment, the article of clothing comprises a garment with long legs such as a pair of pants or capris. The system may be positioned in a variety of locations in the garment to alter the fit or look of the article of clothing in any desired area. For example, the system may be positioned to adjust the fit of the clothing proximate to one or more of the wearer's legs, waist, chest, and arms. In one embodiment, the system is positioned in each leg of the garment and is adapted to adjust the fit of at least a portion the legs of the garment. In still another embodiment, the system is positioned in at least one of: an inner portion of a leg, an outer portion of the leg, a front portion of the leg, and a back portion of the leg of the garment.

In one embodiment, the article of clothing is a pair of shorts. The shorts comprise one of road biking shorts, mountain biking shorts, cyclocross shorts, cycling shorts, spinning shorts, biking shorts, triathlon shorts, cross-fit shorts, yoga shorts, climbing shorts, running shorts, hiking shorts, walking shorts, lacrosse shorts, soccer shorts, dance shorts, swim or surf shorts, or any athletic, technical or just mood shorts in general. In another embodiment, the article of clothing comprises one of a pair of pants, a pair of yoga pants, a pair of dance pants, a pair of rain pants, a skirt, a skort, a pair of skorts, a jumpsuit, a full-liner, a pair of tights, a pair of hose, an undergarment, a shirt, a jacket, a sweater, a jacket, a dress, capri pants, a skating dress, a skating costume, a costume, and a wedding dress.

In some embodiments, in the first configuration of the system, a circumference of a portion the article of clothing has a first dimension and the article of clothing has a loose fit. In the second configuration of the system, the circumference of the portion of the article of clothing has a second dimension that is less than the first dimension and the article of clothing has a tighter fit. The system may be positioned in one or more intermediate positions with circumferences between the first dimension and the second dimension.

In one embodiment, the first, second, and third panels are formed from one type of fabric. In another embodiment, a fabric of at least one of the first, second, and third fabric panels is selected to change a rate of ventilation provided in the first configuration compared to the second configuration. In still another embodiment, a fabric of at least one of the first, second, and third fabric panels selected to increase the visibility of the article of clothing when the system is in one of the first and the second configurations. In yet another embodiment, the first, second, and third panels are formed of one piece of fabric without seams. In still another embodiment, one of the first, second, and third panels is interconnected to the other two panels by at least one seam.

In accordance with one aspect of the present invention, a novel method of selectively adjusting a fit of an article of clothing is provided. This includes, but is not limited to, a method generally comprising: (1) providing an article of clothing comprising a system adapted to adjust the fit of the article of clothing, the system comprising a first fabric panel, a second fabric panel, a third fabric panel, and a first closure, the first fabric panel being interconnected to the second fabric panel by the first closure and the third fabric panel being positioned between the first and second fabric panels; (2) moving the first closure of the system to an open position to place the system in a first configuration; and (3) moving the first closure of the system to a closed position to place the system in a second configuration, at least a portion of the article of clothing having a tighter fit in the second configuration than in the first configuration. In one embodiment, the method may further comprise (4) moving a second closure of the system to a ventilation position in which a first portion of the system is at least partially closed and a second portion of the system is at least partially opened, wherein an amount of air allowed to enter the article of clothing is changed. In one embodiment, moving the second closure of the system to the ventilation position comprises closing the second closure. When closed, the second closure is positioned proximate to a hem line of the article of clothing, and the first closure of the system is in the open position. In another embodiment, in the ventilation position, the system provides a changed ventilation as desired as well as the ability to tighten only a portion of the article of clothing for privacy and/or to restrict or limit unintended or inadvertent movement of article of clothing.

The system and method of the present invention provides numerous advantages, including varying the tightness and/or fitting of clothing and/or providing a variable degree of ventilation. An individual wearing clothes with the system is not compelled to change clothes during an activity or after completing one activity before beginning a second activity or to remain uncomfortable or cause discomfort in public environments. In various embodiments, the system of the present invention may include safety features, such as reflective fabric, trim and/or lights, that can be revealed and/or concealed to alter the visibility of the clothing when beneficial or desired. Another advantage of the present invention is a system that enables clothing to be adjusted as appropriate for one or more activities. In another embodiment, the system of the present invention can improve and/or affect circulation, swelling and/or mobility of an individual by tightening or loosening one or more areas of the clothing.

Still another aspect of the present invention is to provide a liner adapted to be worn beneath an article of clothing of the present invention. The liner is adapted to be interconnected to the clothing. In one embodiment, the liner is a separate piece of clothing that is selectively removable from the external article of clothing. The liner may be comprised of one or more fabric panels. In one embodiment, at least one panel of the liner is positioned to at least partially align with one fabric panel of a system adapted to adjust the fit of an external article of clothing. Accordingly, the liner may comprise a fabric panel that at least partially aligns with a third portion of the external article of clothing when the system is in one of the first and second configurations. The liner may further comprise a holding system to releasably secure a chamois pad within an interior of the liner. The holding system may comprise a front holding system and a rear holding system. In one embodiment, the front and rear holding systems comprise pockets with a size and shape adapted to receive at least a portion of a chamois pad. In another embodiment, the front and rear holding systems comprise a closure. In one embodiment, the liner is adapted for use with any article of clothing that includes a system to adjust the fit of the present invention.

One aspect of the present invention is a chamois pad. The chamois pad has a body with a generally curvilinear shape. In one embodiment, the shape of the chamois pad is adapted to fit within a holding system of an article of clothing. In one embodiment, the shape of the chamois pad to adapted to fit at least partially within a front and a rear pocket positioned within an interior of an article of clothing. The chamois pad comprises a front portion adapted to be positioned in the front portion of an article of clothing. A rear portion of the chamois pad is adapted to be positioned in the rear portion of the article of clothing. A medial portion between the front and rear portions is generally narrower than each of the front and rear portions. In one embodiment, the rear portion has a greater width than the front portion. The chamois pad may further include an attachment system to selectively interconnect the chamois pad to an article of clothing. In one embodiment, the attachment system comprises a closure. In one embodiment of the present invention, the chamois pad is adapted for use with any article of clothing comprising a system to adjust the fit of the present invention.

The above-described embodiments, objectives, and configurations are neither complete nor exhaustive. As will be appreciated, other embodiments of the invention are possible using, alone or in combination, one or more of the features set forth above or described in detail below.

Although generally referred to herein as "clothing," "shorts," or "bike shorts," it should be appreciated that the system and method of the current invention may be used with clothing, apparel, or garments for men and women of any type, style, or size and for any type of activity, including without limitation pants, shirts, jackets, sweaters, skirts, skorts, dresses, capris, jumpsuits (or "onesies"), full liners, undergarments, swimsuits, tights, and hose. As will be appreciated by one of skill in the art, the present invention may be used with clothing comprising any type of fabric known or developed in the future.

As used herein, the term "closure" generally refers to any currently known or future developed closure system. Thus, a closure may comprise a hook and loop material (or Velcro™), magnets, zippers, double (or two-way) zippers, a ziplock system, a ruching system (wherein fabric is gathered with cording as will be understood by those of skill in the art), a lacing system, a bungee system, a Boa system, overlapping fabrics, buttons, snaps, a drawcord, flaps, tabs, and/or a camlock, and/or any closing, adjusting or tightening system for the closure.

Although the system of the present invention is generally illustrated in a generally vertical orientation in a leg portion of the clothing, it should be understood that the system can have any orientation and may be located at one or more other locations of an article of clothing, including one or more of a waist portion, a hip portion, a front thigh portion, an inner thigh portion, a back portion of a leg, an arm portion, a body portion, and/or a back portion. Further, multiple systems of differing lengths may be used in combination in the same locations of an article of clothing. Additionally, the system may be positioned on the outside of the clothing and visible or the system can be positioned on an interior portion of the clothing and therefore hidden when the clothing is worn. The system may also be at least partially covered by a portion of fabric.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF DRAWINGS

The accompanying drawings, which are incorporated herein and constitute a part of the specification, illustrate embodiments of the invention and together with the Summary of the Invention given above and the Detailed Description of the drawings given below serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

Figure 2:
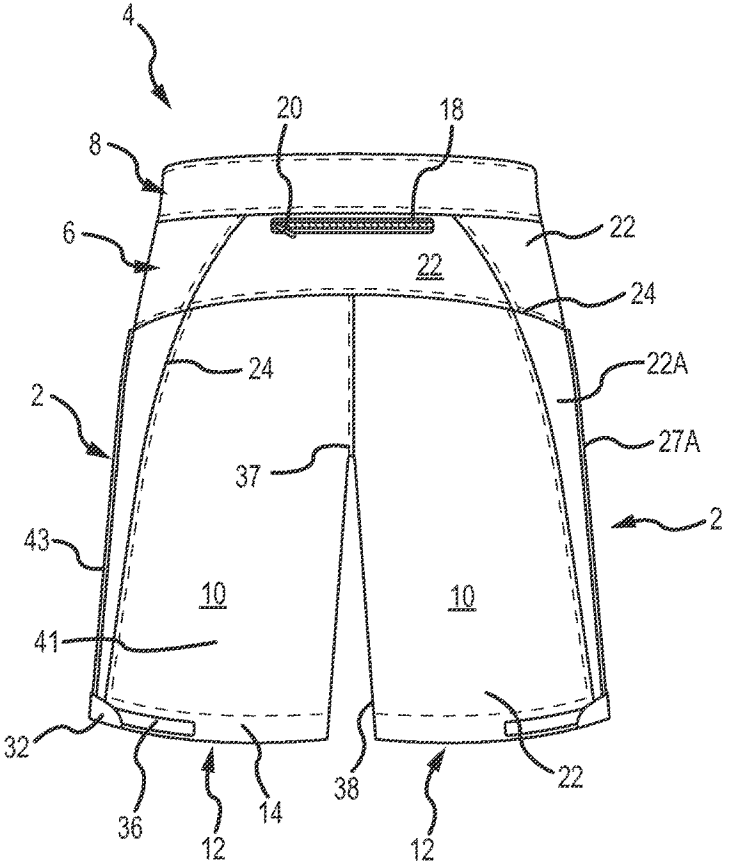
FIG. 2 is a rear perspective view of the shorts of FIG. 1.

Similar components and/or features may have the same reference number. Components of the same type may be distinguished by a letter following the reference number. If only the reference number is used, the description is applicable to any one of the similar components having the same reference number.

To assist in the understanding of one embodiment of the present invention the following list of components and associated numbering found in the drawings is provided herein:

| Number | Component |
|---|---|
| 2 | System |
| 4 | Shorts |
| 6 | Body portion |
| 8 | Waist portion |
| 10 | Leg portions |
| 12 | Leg openings |
| 14 | Hem |
| 16 | Closure |
| 18 | Pockets |
| 20 | Closure |
| 22 | Panels |
| 22A | First panel |
| 22B | Second panel |
| 22C | Third panel |
| 23A | First side of third panel |
| 23B | Second side of third panel |
| 23C | Third side of third panel |
| 24 | Seam |
| 26 | Closure |
| 27A | First closure portion |
| 27B | Second closure portion |
| 28 | First configuration |
| 30 | Second configuration |
| 32 | Tab |
| 34 | Free end |
| 36 | Attachment point |
| 37 | Crotch portion |
| 38 | Inner leg |
| 39 | Front portion |
| 41 | Back portion |
| 43 | Lateral portion |
| 44 | Liner |
| 46 | Front holding system |
| 48 | Rear holding system |
| 49 | Opening |
| 50 | Removable chamois pad |
| 52 | Front end |
| 54 | Rear end |
| 56 | Longitudinal sides |
| 58 | Attachment system |
| 102 | System |
| 104 | Shorts |
| 106 | Body portion |
| 108 | Waist portion |
| 110 | Leg portions |
| 112 | Leg openings |
| 114 | Hem |
| 116 | Closure |
| 118 | Pockets |
| 120 | Closure |
| 122 | Panels |
| 122A | First panel |
| 122B | Second panel |
| 122C | Third panel |
| 123A | First side of third panel |
| 123B | Second side of third panel |
| 123C | Third side of third panel |
| 124 | Seam |
| 126 | Closure |
| 27A | First closure portion |
| 27B | Second closure portion |
| 128 | First configuration |
| 130 | Second configuration |
| 132 | Tab |
| 134 | Free end |
| 136 | Attachment system |
| 139 | Front portion |
| 141 | Back portion |
| 143 | Lateral portion |

-continued

| Number | Component |
|---|---|
| 202 | System |
| 204 | Shorts |
| 206 | Body portion |
| 208 | Waist portion |
| 210 | Leg portions |
| 212 | Leg openings |
| 214 | Hem |
| 216 | Closure |
| 218 | Pockets |
| 219 | Liner |
| 220 | Closure |
| 222 | Panels |
| 222A | First panel |
| 222B | Second panel |
| 222C | Third panel |
| 224 | Seam |
| 225 | Aperture |
| 226A | First closure |
| 226B | Second closure |
| 227A | First portion of zipper |
| 227B | Second portion of zipper |
| 228 | First configuration |
| 229 | Slide |
| 230 | Second configuration |
| 231 | Third configuration |
| 233 | Draw-cord |
| 236 | Attachment point |
| 238 | Strap |
| 239 | Front portion |
| 240 | Fixed end of strap |
| 241 | Back portion |
| 242 | Free end of strap |
| 243 | Lateral portion |
| 244 | Retaining element |
| 246 | Front holding system |
| 248 | Rear holding system |
| 249 | Opening |
| 302 | System |
| 304 | Shorts |
| 306 | Body portion |
| 308 | Waist portion |
| 310 | Leg portion |
| 312 | Leg opening |
| 314 | Hem |
| 318 | Pockets |
| 320 | Closure |
| 322 | Panels |
| 322A | First panel |
| 322B | Second panel |
| 322C | Third panel |
| 324 | Seam |
| 325 | Aperture |
| 326A | First closure |
| 326B | Second closure |
| 327 | Slide |
| 328 | First configuration |
| 330 | Second configuration |
| 333 | Draw-cord |
| 339 | Front portion |
| 341 | Back portion |
| 343 | Lateral portion |
| 402 | System |
| 404 | Shorts |
| 406 | Body portion |
| 408 | Waist portion |
| 410 | Leg portions |
| 412 | Leg openings |
| 414 | Hem |
| 416 | Closure |
| 418 | Pockets |
| 420 | Closure |
| 422 | Panels |
| 424 | Seam |
| 426 | Closure |
| 427 | Slide |
| 428 | First configuration |
| 430 | Second configuration |

-continued

| Number | Component |
|---|---|
| 433 | Draw-cord |
| 434 | Free end |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1:
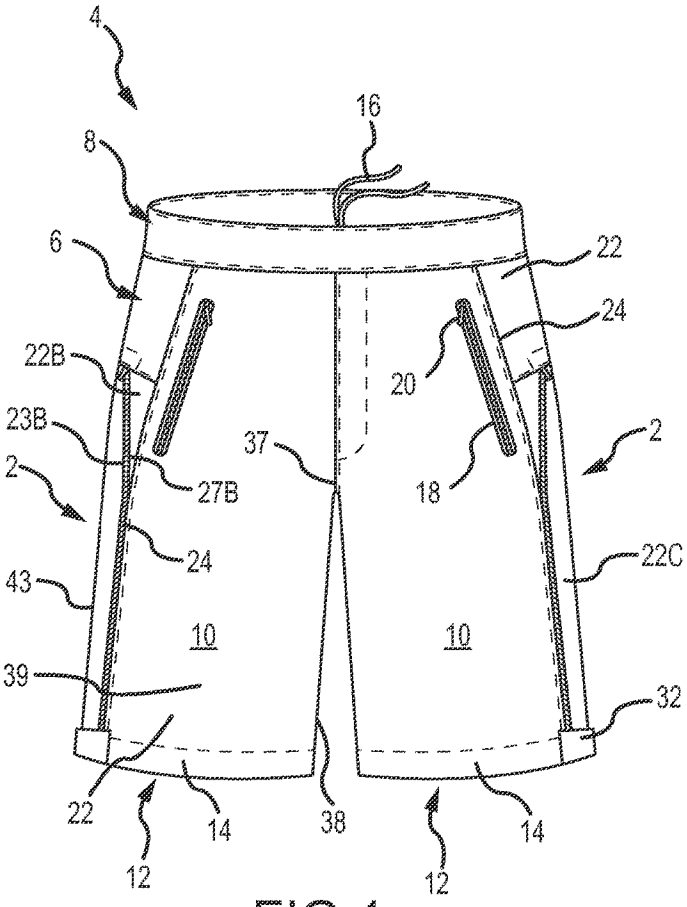
FIG. 1 is a front perspective view of shorts with a system of one embodiment of the present invention to adjust the fit of the shorts with the system in a first configuration comprising a loose fit.

Referring now to FIGS. 1-4, a system 2 to selectively adjust the fit of clothing according to one embodiment of the present invention is illustrated. More specifically, the system 2 according to one embodiment of the present invention is illustrated in a pair of shorts 4. The shorts 4 generally include a body portion 6, a waist portion 8 with an opening, leg portions 10, and leg openings 12. In one embodiment, the leg portions 10 include a hem 14. The waist portion 8 and/or the hem 14 may optionally include elastic or any other type of fabric that may stretch in two or four directions. In one embodiment, the waist portion 8 includes a closure 16. In the embodiment illustrated in FIGS. 1-4, the closure 16 is a drawstring. Belt loops may also be provided proximately to the waist portion 8. As will be appreciated, the shorts may include a zipper fly, button fly, Velcro fly and/or other such mechanisms. Additionally or alternatively, the shorts may include one or more pockets 18. The pockets may optionally include a closure 20, such as a zipper. In one embodiment, the shorts 4 are comprised of one or more panels 22 of fabric joined by seams 24. As illustrated in FIGS. 1-2, the left and right portions of the shorts 4 are generally symmetric. However, it will be appreciated by one of skill in the art that in some embodiments the left portion of the shorts may be different from the right portion of the shorts.

Figure 3A:
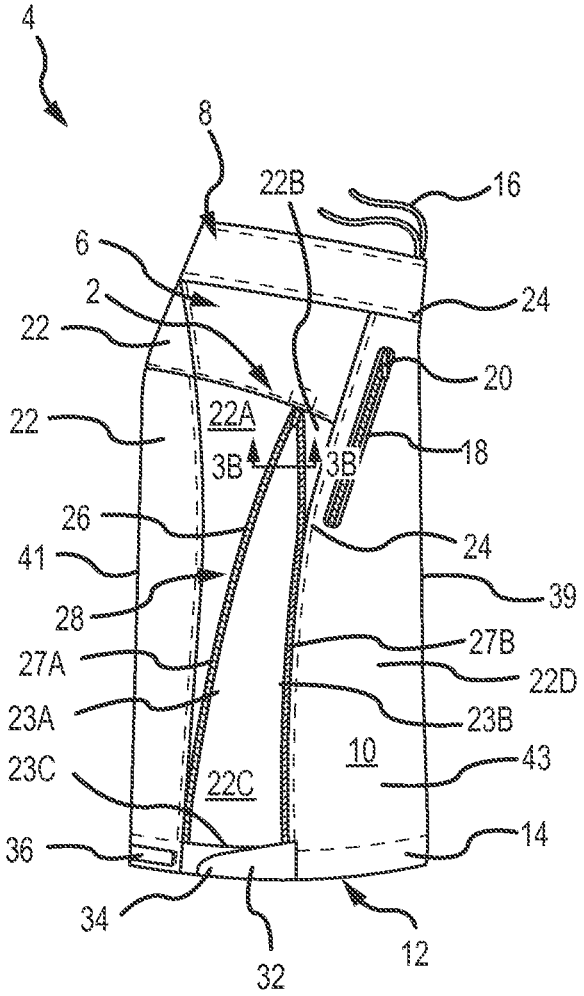
FIG. 3A is a left side elevation view of the shorts of FIG. 1.

The system 2 comprises a closure 26 interconnected to a predetermined portion of the shorts. In one embodiment, the system 2 includes at least one first fabric panel 22A interconnected to at least one second fabric panel 22B by a closure 26. A third fabric panel 22C is interconnected to the closure 26 and positioned between the first and second fabric panels 22A, 22B. Although the second panel 22B is illustrated in FIGS. 1-4 proximate to only a portion of the closure 26, it will be appreciated by one of skill in the art that the second panel 22B may have any desired size and shape. Optionally, in one embodiment, the second panel 22B extends at least from an upper portion to a lower portion of the closure 26 similar to the embodiment of the system 102 illustrated in FIGS. 15-16. The at least one first fabric panel 22A can be interconnected to two or more second fabric panels, as illustrated in FIGS. 3-4 where panel 22A is interconnected to portions of panels 22D and 22B.

Figure 3B:
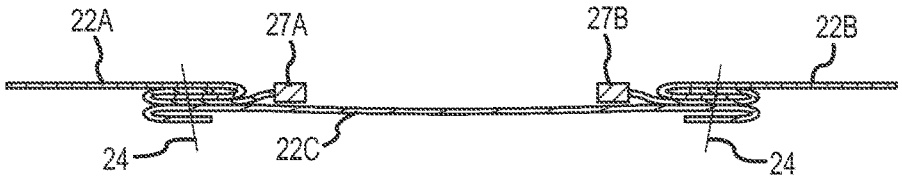
FIG. 3B is a partial cross-sectional view of the system of the shorts of FIG. 3A taken along the line 3B showing the system in the first configuration.

In one embodiment, illustrated in FIG. 3B, each of the first, second, and third fabric panels 22A, 22B, and 22C are formed of different pieces of material interconnected by seams 24. The seams 24 illustrated in FIG. 3B may be of any type to join different pieces of fabric together, and may comprise more than one type of seam. Examples of a variety of seams that may be used to join the panels together are described in more detail hereinafter. In another embodiment, illustrated in FIG. 3C, the first, second, and third fabric panels 22A, 22B, 22C comprise portions of one piece of fabric. In another embodiment, at least one of the first, second, and third fabric panels is a separate piece of fabric interconnected to the other fabric panels by at least one seam 24. For example, the first and second panels 22A, 22B may be one piece of fabric interconnected to a separate third panel 22C by a seam. Alternatively, in another embodiment, the first and third panels 22A, 22C may be formed of one piece of fabric that is interconnected to a separate second panel 22B. Optionally, in still another embodiment, the second and third panels 22B, 22C are formed of one piece of fabric. The first panel 22A is interconnected by a seam to the second and third panels 22B, 22C.

In one embodiment, the third panel 22C is formed of two pieces of fabric. In another embodiment, the third panel 22C is formed of a single piece of fabric. In one embodiment, the single piece of fabric of the third panel 22C is devoid of darts. In yet another embodiment, the third panel 22C is devoid of seams between the first side 23A and the second side 23B.

In one embodiment, the system 2 is arranged such that the closure 26 closes in a downward direction from an upper portion of the article of clothing proximate to the waist portion 8 to a lower portion of the article of clothing proximate to the hem 14. The third panel 22C may have a generally triangular shape. In one embodiment, the two longer sides 23A, 23B of the third panel 22C are proximate to a first portion 27A and a second portion 27B of the closure 26. Accordingly, a first edge 23A of the third panel 22C is interconnected to the first portion 27A of the closure and a second edge 23A of the third panel 22C is interconnected to the second portion 27B of the closure. In another embodiment, the first edge 23A of the third panel 22C is interconnected to an edge of the first panel 22A and the second edge 23B of the third panel is interconnected to an edge of the second panel 22B. Further, a third edge 23C of the third panel 22C is proximate to the hem 14 and an opposite vertex of the third panel 22C is proximate to the waist portion 8. In one embodiment, the third edge 23C is smaller than the other two edges 23A, 23B of the third panel 22C.

In the embodiment illustrated in FIGS. 1-4, the closure 26 is a zipper; however, as will be appreciated by those of skill in the art, any currently known or future developed closure may be used with the system 2 of the present invention. For example, the closure 26 may comprise one or more of a hook and loop material (or velcro), magnets, zippers, double (or two-way) zippers, a ziplock system, a bungee system, a ruching system (wherein fabric is gathered with cording as will be understood by those of skill in the art), a lacing system, a Boa system, overlapping fabrics, buttons, snaps, a draw-cord, and/or any type of closure used at a bottom of a leg of a garment (including a camlock, Velcro tabs, snaps, buttons, and/or magnets). In one embodiment, the closure comprises a draw-cord with a free end that is accessed from an interior space of a pocket. In another embodiment, the draw-cord is comprised of a stretchable material that is reflective. In one embodiment, the closure is positioned proximate to the hem 14 of each leg 10. In yet another embodiment, the closure comprises a stretchable draw-cord positioned in the hem 14 of each leg 10. In still another embodiment, the closure is a tab 32 positioned proximate to the hem 14. In yet another embodiment, the closure may comprise a plurality of tabs 32. As will be appreciated, the system 2 may be used without the tab 32 illustrated in FIGS. 1-4. Alternatively, the system may include only the tab 32 and/or other such tightening system.

The system 2 may include one or more closures 26 of more than one type used in combination together (and by themselves). In one embodiment, the system 2 is positioned on an outer thigh portion of the shorts 4 and extends substantially from a waistline at the upper waist portion 8 to the hem 14 to selectively enable a wearer to adjust the fit of the shorts 4. As will be appreciated by those of skill in the art, the placement of the closure 26 is not limited to the location or the orientation illustrated in FIGS. 1-4.

In operation, as the closure 26 is moved from a substantially open position illustrated in FIGS. 1-3 to a substantially closed position illustrated in FIG. 4, the system 2 transitions from a first configuration 28 (a "loose fit" configuration) illustrated in FIGS. 1-3 to a second configuration 30 (a "tight fit" configuration) illustrated in FIG. 4. The fit of each leg of the shorts 4 generally tightens along the length of the closure 26 as the closure 26 is closed. In this manner, the user can adjust the fit of the shorts 4 in more than one location.

In one embodiment, the third side 23C of the third panel 22C is less than approximately 3 inches long. Accordingly, in the first configuration 28 of the system 2, the circumference of the hem portion 14 is up to approximately 3 inches longer than the hem circumference when the system is in the second configuration 30. It will be appreciated that the third side 23C can have any desired length. In another embodiment, the third side 23C is between approximately 0.5 inches and approximately 3.5 inches. In still another embodiment third side 23C has a length of from about 1 inch to about 2 inches. In yet another embodiment, the circumference of the hem portion 14 is selected to be substantially the same as the circumference of the user's leg proximate to the hem portion when the system 2 is in the second configuration 30. Said another way, when the system is in the second configuration, there is no space between the interior surface of the hem or leg portions 10 and the user's leg. Accordingly, in the second configuration the system 2 provides a generally skin tight fit on the user's leg.

When the closure 26 is in the open position, the third panel 22C maintains a spaced relationship between the first and second panels 22A, 22B. The third panel 22C is also visible and forms a portion of the exterior surface of the shorts 4 when the closure 26 is at least partially in the open position.

As the closure 26 moves from the substantially open position to the closed position, the fabric of the first panel 22A and the second panel 22B are drawn together, decreasing a circumference (or exterior dimension) of at least a portion of the shorts 4 to tighten the fit of the shorts 4. In the embodiment illustrated in FIG. 4, the fabric of the third panel 22C is then at least partially hidden by the closure 26 and the third panel 22C is positioned toward the interior of the shorts 4 when the system 2 is in the second configuration 30. In one embodiment of the present invention, no portion of the third panel 22C is visible when the system 2 is in the second configuration.

Optionally, the system 2 may include reflective tabs, cording, piping, sparkles, logos, trim, prints or other fabrics and/or systems that help make the shorts 4 (or parts thereof) more visible in varying environments. For example, in one embodiment, the fabric of the third panel 22C is a different color than the fabric of the first and second panels 22A, 22B. In another embodiment, the third panel 22C is made of a fabric that is more reflective (or less reflective) than the fabric of one of the first and second panels 22A, 22B. In still another embodiment, the system 2 includes a reflective fabric or thread. The reflective fabric or thread is visible when the system 2 is in one of the first configuration 28 or the second configuration 30; however, the reflective fabric or thread is not visible when the system is in the other of the first configuration 28 or the second configuration 30.

In yet another embodiment, the system 2 includes lights that activate or deactivate when the system 2 is in one of the first configuration 28 or the second configuration 30. In another embodiment, the system 2 includes lights that are visible or hidden in one of the first configuration 28 or the second configuration 30. In another embodiment, movement of the closure 26 may activate or deactivate the lights or, alternatively, reveal or hide the lights. In still another embodiment, a light is interconnected to the system 2 and the light is activated when the system 2 is in one configuration. Each of these embodiments enable a wearer to use the system 2 to adjust the visibility of the shorts 4.

Optionally, the system 2 may include one or more tabs 32 with a free end 34 that can be selectively attached to the shorts 4 at multiple attachment points 36. The tab 32 may optionally be positioned to cover at least a portion of the closure 26 when the closure 26 is in the closed position, as illustrated in FIG. 4. By at least partially covering the closure 26, the tab 32 may prevent unintended or inadvertent opening or movement of the closure 26 during activity of the wearer of the shorts 4. In one embodiment, the tab 32 is positioned at least partially in the hem 14 of the shorts 4 to selectively adjust the circumference of the hem 14. In one embodiment, a hook and loop material is provided on an inner surface of the tab 32 and the attachment points 36 on an exterior surface of the shorts 4 to enable the selective attachment of the free end 34 to the shorts 4 in a variety of locations. However, as will be appreciated by those of skill in the art, the attachment points 36 may be formed by snaps, magnets, buttons, or any other attachment means to enable the selective attachment of the free end 34 of the tab 32 to the shorts 4. In one embodiment, the system 2 includes only one of a tab 32 and a closure 26. In another embodiment, the system 2 includes an elastic hem 14 that adjusts the circumference of the hem as the system is moved between the first and second configurations 28, 30. In still another embodiment, the leg portions 10 and the hem 14 are adapted so that the shorts narrow sufficiently at the hem 14. For example, in one embodiment of the present invention, the fabric of the shorts 4 is cut to narrow the hem 14.

Each of the panels 22 of the shorts 4 may include one or more different fabrics of any known or future developed material. In one embodiment, the first, second, and third fabric panels are formed of the same type of fabric. In another embodiment, at least one of the first, second, and third fabric panels is formed of a different type of fabric than the other fabric panels. In yet another embodiment, each of the first, second, and third fabric panels is formed of a different type of fabric. In still another embodiment, the fabric of one or more of the first, second, and third fabric panels is the same as the fabric of one or more of the body, waist, and leg portions of the shorts 4. In one embodiment, one or more of the panels 22 are formed of a non-stretch woven fabric, such as cotton, polyester, wool, nylon, or any combination thereof. In another embodiment, one or more of the panels 22 are formed of a stretch woven fabric made of cotton, polyester, nylon, spandex yarn/stretch yarn, lycra, mesh or any combination thereof. In still another embodiment, a 2-way stretch knit fabric that stretches in one direction only is used the form the panels 22. The 2-way stretch knit fabric may be made of a synthetic material with spandex yarn and can be positioned to stretch in any direction, either the warp or the weft. In yet another embodiment, one or more of the panels 22 are formed of a 4-way stretch knit fabric. The 4-way stretch fabric can stretch in two directions (for example, both vertically and horizontally) and may be made of a synthetic material with spandex yarn. In one embodiment, the 4-way stretch fabric may allow a greater stretch percentage in a first direction and a lesser stretch percentage in a second direction transverse to the first direction. In yet another embodiment, one or more of the panels 22 are made of knit wool fabrics with or without stretch yarns.

Mesh fabrics may be used to form one or more of the panels 22 or portions of the panels 22 of the system 2. The mesh fabric may be an open mesh breathable fabric made of any natural or synthetic material, including without limitation, yarn. In one embodiment, the mesh fabric may have a 2-way stretch, a 4-way stretch, or no stretch. Optionally, the mesh fabric of the system 2 may be selected to provide more stretch compared to the fabric of the other panels of the article of clothing 4.

Figure 3C:
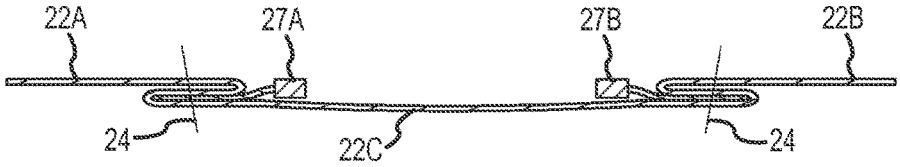
FIG. 3C is a partial cross-sectional view, similar to the view of FIG. 3B, of a system of another embodiment of the present invention, the system comprising one piece of fabric interconnected to a closure.
Figure 4:
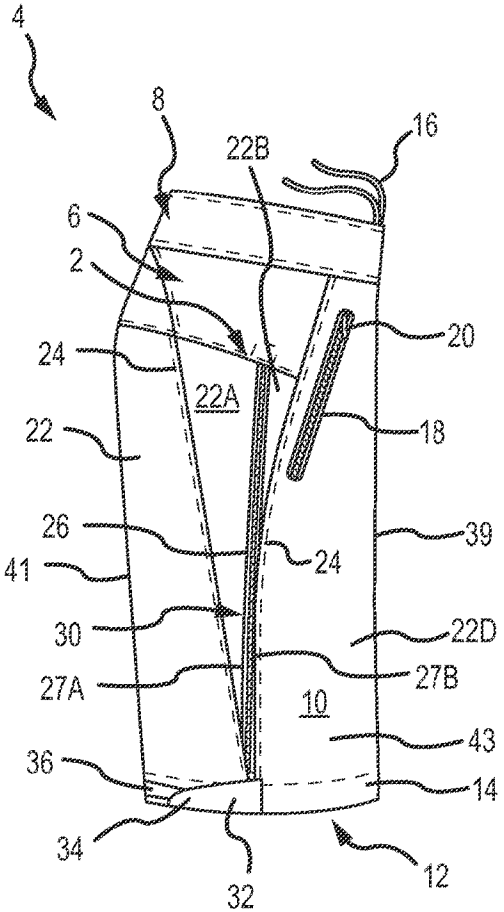
FIG. 4 is a left side elevation view of the shorts of FIG. 1 with the system to adjust the fit of the shorts in a second configuration comprising a tight fit.

Accordingly, the third panel 22C may be formed of a mesh fabric. When the system is at least partially in the first configuration 28, more ventilation is provided to the wearer because at least some of the mesh third panel 22C is exposed. When the system is in the second configuration 30, less ventilation is provided. In another embodiment, the third panel 22C and portions of the first and second panels 22A, 22B proximate to the first and second portions 27A, 27B of the closure 26 are formed of a mesh fabric. In this embodiment, the system provides at least some ventilation in each of the first and second configurations. Optionally, each of the panels 22A, 22B, and 22C comprising the system 2 are formed of mesh fabric. The panels of the system 2 may be interconnected to other panels of the shorts 4 that are comprised of a non-mesh fabric. In one embodiment, each of panels 22A, 22B, and 22C are formed from one piece of mesh material, as illustrated in FIG. 3C.

Additionally or alternatively, fabrics used to form the panels 22 may include anti-bacterial treatments. The fabrics may optionally include treatments and/or a weave to make the panels 22 waterproof (or at least partially water-resistant) and/or breathable. One or more fabrics may be wind proof. One or more fabrics may provide protection from the sun. For example, fabrics may be selected with a predetermined ultraviolet protection factor (or "UPF") as will be appreciated by one of skill in the art. The third panel 22C may be formed of a material with a lower UPF than material of other portions of the article of clothing. In the first configuration 28, the system provides more exposure to ultra-violet (UV) light. In the second configuration, the system provides less UV exposure. Accordingly, the system 2 may be adapted to control an amount, or location, of UV light protection provided by the article of clothing.

The fabrics of any of the panels 22 may be comprised of any natural or synthetic fiber and any combination thereof. The panels 22 may also include, or be made of, fabrics that wick moisture away from the body of the wearer and/or help regulate core body temperature. Still other panels 22 may be made of fabrics that incorporate other technologies, materials, and characteristics to help regulate body temperature or provide other performance, health, and/or comfort enhancements.

The fabric used for each panel 22 may be selected based on the location of the panel 22. For example, a non-stretch woven or knit fabric may be selected for panels 22 to provide stability in areas where no stretch is required. When a non-stretch fabric is used in one panel 22 and a stretch fabric in used in another panel 22 (for example, placed along a closure system or aligned on one side of a closure such as a zipper), the combination can allow for ease of movement and stretch over moving body parts. Alternatively, a combination of stretch fabric and non-stretch fabric can be designed to engage with the hip, thigh, and/or joints of the wearer for greater comfort and ease of use as determined by the style of the shorts or a targeted activity of the wearer. Both 2-way and 4-way stretch fabrics can be used in combination with non-stretch fabrics. Further, stretch fabrics can be used with a combination of higher or lower percentages of stretch yarns in order to allow for maximum stretch when necessary, or lower stretch percentage if compression is required for health benefits or requirements of the activity. For example, a lower stretch percentage may be use for cycling shorts.

In one embodiment, one of the first panel 22A, the second panel 22B, and the third panel 22C comprises a stretchable fabric and another of the panels 22A, 22B, and 22C comprises a non-stretchable fabric. In another embodiment, each of the first panel 22A, the second panel 22B, and the third panel 22C comprise a stretchable fabric. In still another embodiment, each of the first panel 22A, the second panel 22B, and the third panel 22C comprise a non-stretchable fabric. The amount of stretch provided by the fabric of each panel as well as the orientation of the panels may be selected to control the amount of flexibility or stiffness provided by the system. For example, in one embodiment of the present invention, at least a portion of the article of clothing may be stiffer in one of the first and second configurations compared to a second one of the first and second configurations.

The 2-way and 4-way stretch fabrics can be placed on a vertical or a horizontal grain direction, or on a bias (or diagonal) direction in order to make the best use of the stretch properties of the fabric as determined the style of the shorts, the targeted activity, and the location of the panel 22 comprised of the fabric. Mesh fabrics that are either stretchable or non-stretchable can be used for one or more panels 22 for breathability, ventilation, comfort, odor control, and ease of movement. In one embodiment, at least a portion of one of the first panel 22A, the second panel 22B, and the third panel 22C comprises a mesh fabric and another of the first panel 22A, the second panel 22B, and the third panel 22C comprises a non-mesh fabric. In another embodiment, one or more of the panels 22 may comprise two or more fabrics, including fabrics of different types. For example, at least one of the panels 22 may include a first fabric interconnected to a second different fabric. In one embodiment, the first fabric is a 2- or 4-way stretch fabric and the second fabric is a different 2- or 4-way stretch fabric oriented with a different bias direction.

The panels 22 may be joined together with seams 24 of any type, or with a combination of seam types. For example, one or more of flatlock seaming, overlock/serge seaming, overlock/serge and coverstitch seaming, single needle lockstitch seaming, and welding may be used to join the panels 22. As will be appreciated by one of skill in the art, welding includes heat tape welding, waterproof welding, and any welding tape materials adhered to an outside of the shorts 4 to cover seams 24. Seams 24 can have any desired shape, include substantially straight, curvilinear, circular, and any combination thereof. Additionally, reflective and/or safety tape or threads may be inserted into seams 24 as piping, taping, or tabs. Seams 24 may be formed using any a stretchable or a non-stretchable thread of any material, whether man-made or synthetic. Seams 24 can also be used for purposes other than joining two separate panels 22 of fabric together, including seams located for esthetic purposes or to alter or adjust properties of the fabric. Thus, in one embodiment, at least one panel 22 includes a seam 24 adapted to limit or change the amount of stretch in a selected direction of a 2-way or 4-way stretch fabric. In another embodiment, a seam 24 is provided in a single panel 22 to alter the amount of stretch in a selected portion of the panel 22. Seams 24 may also be provided in a single panel 22 to strengthen or reinforce one or more selected portions of a panel 22. Optionally or alternatively, one or more of panels 22 may be joined by a glue or adhesive.

The system 2 may also be adapted to selectively control ventilation provided to a wearer. For example, by changing the position of the closure 26 to move the system from the first configuration 28 to the second configuration 30, or to an intermediate configuration, the amount of venting can be varied by the user. Varying types of fabrics selected for each of the first, second, and third panels 22A, 22B, 22C may also be used individually and in combination to alter the amount of ventilation provided when the system 2 is in the first or second configuration 28, 30. In one embodiment, the location of the system 2 and the closure 26 is selected to optimize the amount of ventilation provided. Additionally, the closure 26 can be adapted so that when the closure 26 is substantially open a lower portion of the legs 10 proximate the hem 14 is closed and/or tight fitting while an upper portion of system 2 is open and loose fitting. For example, in one embodiment, the closure 26 is comprised of at least one of a double zipper, magnets, a hook and loop material, buttons, tabs, a draw-cord, or snaps. In this embodiment, a lower portion of the closure 26 proximate the hem 14 may be closed, or have a tight fit, when an upper portion of the closure 26 proximate the waist portion 8 is open to increase ventilation while keeping the hem portion tight fitting.

Although the system 2 of the present invention is illustrated in FIGS. 1-4 in a generally vertical orientation on an exterior portion 43 (or lateral portion) of each leg 10 of the shorts 4, one of skill in the art will appreciate that the system 2 can have any desired orientation on the shorts 4 and may be located at one or more other locations on the shorts 4 or any other article of clothing. For example, in one embodiment the shorts 4 include one or more system 2 positioned to adjust the fit of the waist portion 8 of the shorts. In another embodiment, a system 2 is positioned on an inner portion 38 of the legs 10. In still another embodiment, a system 2 is positioned on a front 39 (or anterior) portion of the legs 10. In yet another embodiment, the shorts 4 include a system 2 positioned on a back 41 (or posterior) portion of the legs 10. In one embodiment, the system 2 has a spiral configuration to wrap (at least partially) axially around at least one of the legs 10 or some other portion of the shorts 4. In another embodiment, the shorts 4 include multiple systems 2 of different lengths positioned at various locations and orientations. In still another embodiment, the location and alignment of the system 2 is selected to optimize the aerodynamic properties of the shorts 4 when the system 2 is in the second configuration 30. In this embodiment, the system 2 may be located on a front portion 39 of the legs 10 of the shorts 4.

The system 2 may also be positioned to improve blood circulation of, and/or provide stability to, and/or assist with swelling for the person wearing the shorts 4. For example, in one embodiment, when the system 2 is in the second configuration 30 the tight fit can improve blood circulation of the wearer. In another embodiment, the system 2 may be positioned in a crotch portion 37 of the shorts to improve blood circulation of a male wearing the shorts when the system is in the first configuration 28. Thus, the system 2 can be used to increase or decrease blood circulation in one or more areas of the wearer when the system is in the first and/or second configuration 28, 30.

By changing the location of the system 2, the number of systems 2 used in the shorts 4, the orientation of the system 2, the type of closure 26 used, the length of the system, and/or the fabrics used in the panels 22, any desired degree of tightness can be provided at one or more locations of the shorts 4 by the system 2. For example, in one embodiment, the system 2 provides a skin tight fit similar to the look of spandex in the second configuration 30. In another embodiment, the system 2 provides a loose fit in the second configuration 30. In still another embodiment, a slightly tight fit can be provided by the system 2 when in the second configuration 30.

The system 2 may be used in clothing of any size for men or women. The system 2 can also be adapted for clothing for any type of activity. For example, the system 2 may be adapted to shorts 4 for road biking, mountain biking, cyclocross, spinning or any type of cycling, yoga, cross-fit, climbing, swimming, running, hiking, dancing, rock climbing, lacrosse, soccer, and any other activity. Further, the system 2 may be used with any type of apparel. Thus, the system 2 can be used in one or more locations of shirts, jackets, sweaters, dresses, pants, skirts, skorts, capris, jumpsuits, full liners, tights, hose, or any other type of clothing or apparel as desired for fashion, comfort, and/or performance. In one embodiment, a dress includes the system 2 at one or more locations to enable different looks or styles. Further, the system 2 could be used to alter the fit of the dress based on the level of activity of the wearer. For example, a wedding dress could include the system 2 to change the style of the wedding dress from a first style used at a wedding ceremony to a second style used at a reception or on a dance floor.

Optionally, the shorts 4 may include a holding system adapted to releasably secure a chamois pad within the shorts. The holding system may be the same as, or similar to, systems 46, 48 of the liner 44 described in conjunction with FIG. 14. Alternatively, in another embodiment, a liner 44 may be sewn into the shorts 4. In still another embodiment, a chamois pad, the same as or similar to chamois pad 50, may be sewn into the shorts 4.

Figure 5:
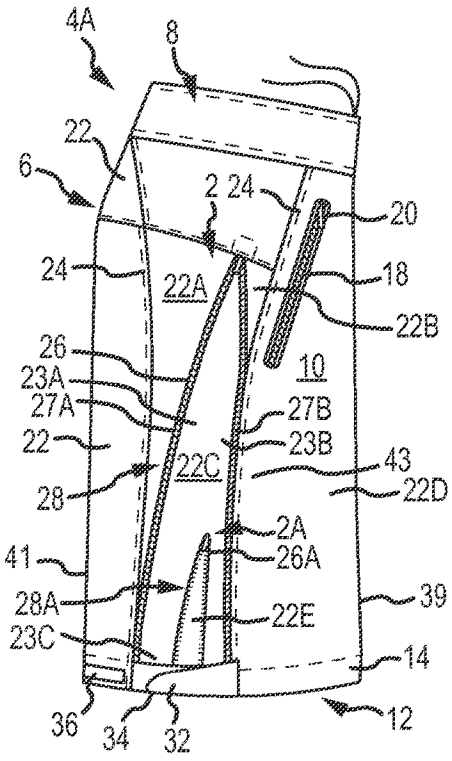
FIG. 5 is a left side elevation view of shorts with another embodiment of a system of the present invention comprising a second closure positioned at least partially between portions of a first closure.

Referring now to FIG. 5, in one embodiment the shorts 4A include a system 2 with a first closure 26 and a second closure 26A positioned on the third panel 22C of the system 2. The second closure 26A includes a panel 22E interconnected to a portion of the third panel 22C of the first closure 26. The second closure 26A can be a different type of closure than the first closure 26. In one embodiment, the second closure 26A is a zipper, as illustrated in FIG. 5. Further, the panel 22E may be formed of the same fabric or a different fabric than third panel 22C. In one embodiment, the panel 22E is a portion of the panel 22C. In operation, the second closure 26A may be moved from the first configuration 28A illustrated in FIG. 5 to a second configuration independently from the first closure 26. Optionally, the second closure 26A can be oriented to close in substantially the opposite direction compared to the first closure 26. Said another way, the second closure 26A could first be pulled upwardly to transition to the second configuration and then the first closure 26 could be pulled downwardly to transition the system 2 to the second configuration 30. In this manner, it may be possible decrease the circumference of the leg and increase the tightness of the leg to a greater degree than if both the first and second closures 26, 26A operate in substantially the same direction. Although only the right side 43 of the shorts 4A are illustrated in FIG. 5, it will be appreciated by one of skill in the art that the left side of the shorts may be substantially symmetric with the right side, and that the left side of the shorts include a system 2 with substantially the same orientation and configuration.

Figure 7:
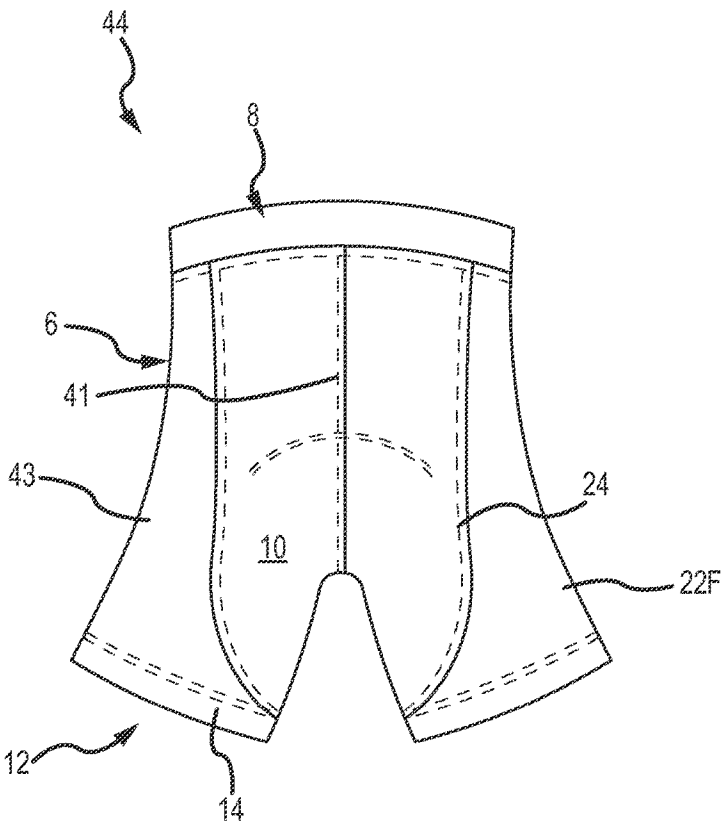
FIG. 7 is a rear perspective view of the liner of FIG. 6.
Figure 6:
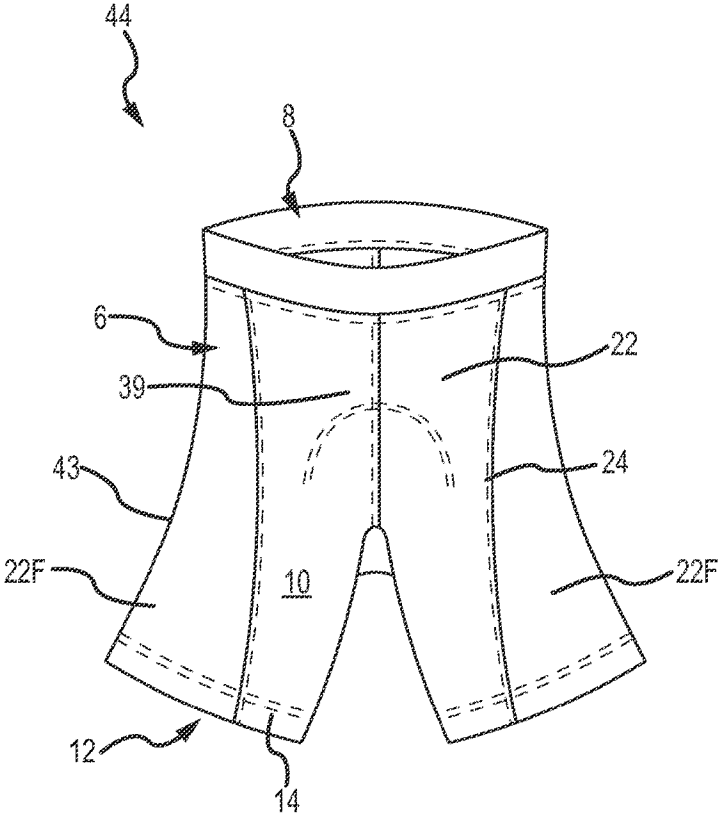
FIG. 6 is a front perspective view of a liner of one embodiment of the present invention that is adapted for use with the shorts of the present invention.
Figure 8:
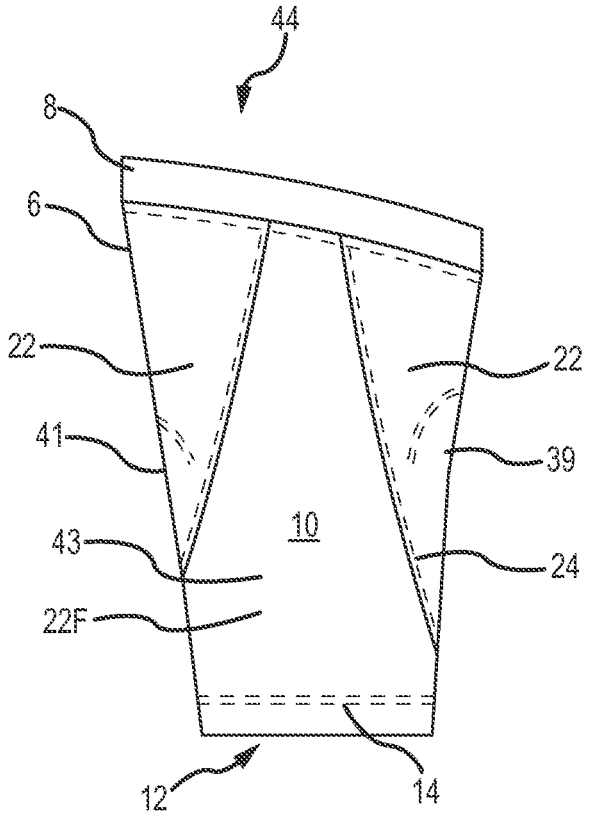
FIG. 8 is a left side elevation view of the liner of FIG. 6.

The shorts 4 of the present invention may be worn over any type of undergarment. For example, and referring now to FIGS. 6-10, the shorts 4 may be worn over a liner 44. In one embodiment, the linen is comprised of a single piece or type of fabric. In another embodiment, the liner 44 may be comprised of one or more panels 22 of fabric. In one embodiment, as illustrated in FIGS. 6-8, the liner 44 may include one or more panels 22F adapted to align at least partially with the system 2 of the shorts 4. In one embodiment, the liner 44 includes a web or mesh fabric along the exterior (or lateral) sides 43 in panel 22F and a different fabric, such as spandex, lycra, and/or a mix with other types of fabric for other panels 22 of the liner 44. The mesh fabric of panel 22F may provide additional ventilation as well as stretch to complement the system 2 of the shorts 4 when the system 2 and panel 22F at least partially align. In one embodiment, the liner 44 may be sewn or otherwise interconnected to the shorts 4. Further, the liner 44 may also comprise a system 2 the same as or similar to system 2 described above in conjunction with FIGS. 1-4. In one embodiment, the liner 44 includes a system 2 position to align with a system to adjust the fit of an outer garment, such as short 4.

Figure 10:
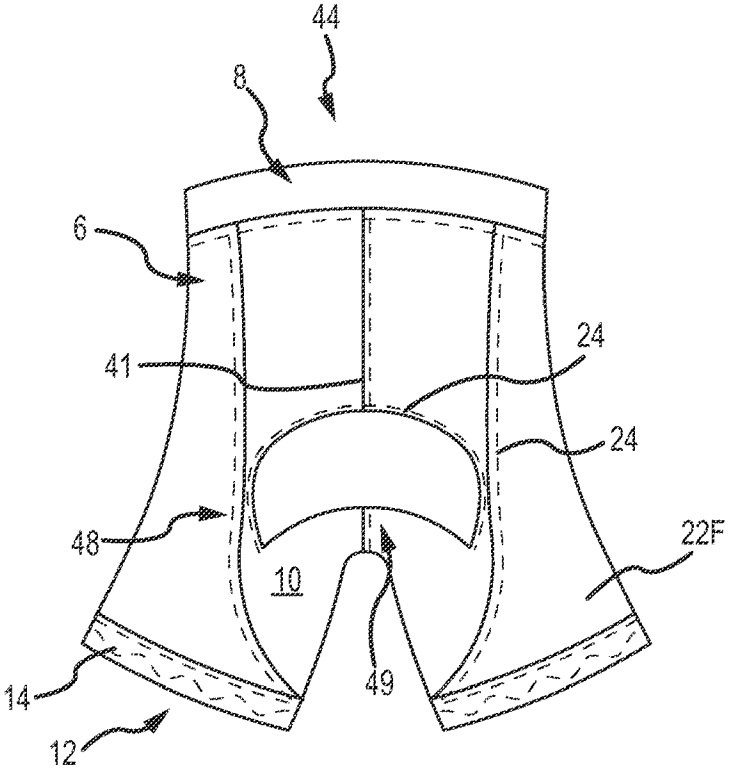
FIG. 10 is a rear perspective view of the liner of FIG. 6 when turned inside out and illustrating a rear holding system for the removable chamois pad.
Figure 9:
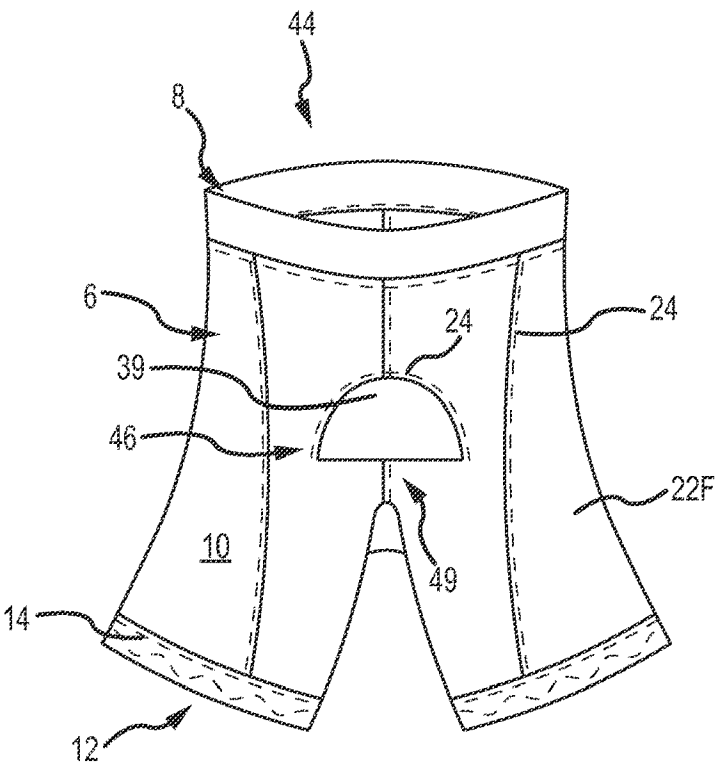
FIG. 9 is a front perspective view of the liner of FIG. 6 when turned inside out and illustrating a front holding system for a removable chamois pad.
Figure 12:
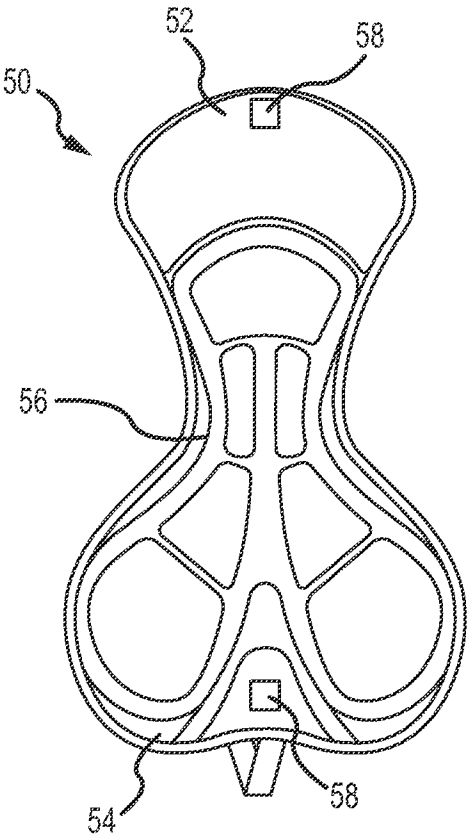
FIG. 12 is a bottom plan view of an exterior surface of the chamois of FIG. 11.
Figure 11:
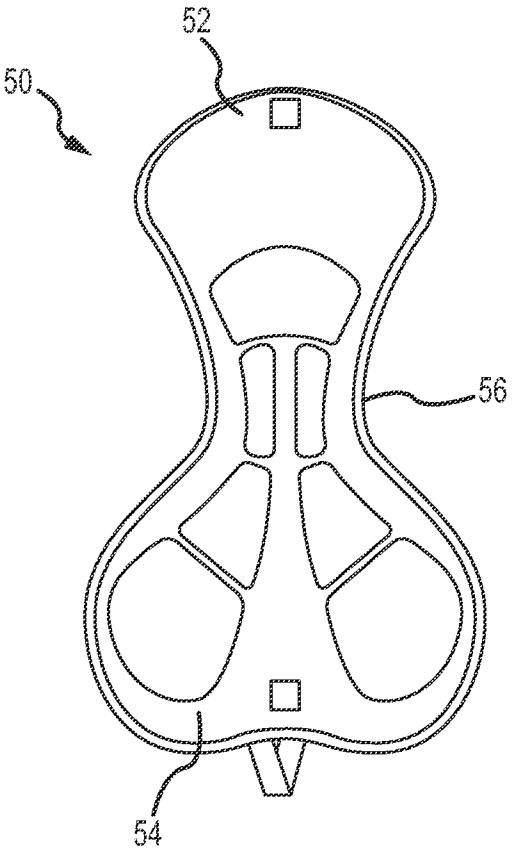
FIG. 11 is a top plan view of an interior surface of a chamois of one embodiment of the present invention that is adapted for use with the shorts and liner of the present invention.

Referring now to FIGS. 9-14, in one embodiment the liner 44 is adapted to removably retain a removable padded chamois pad 50 for cycling. As illustrated in FIGS. 9-10, in which the liner 44 is illustrated turned inside-out for clarity, the liner 44 includes a front holding system 46 and a rear holding system 48 adapted to releasably retain the removable chamois pad 50 within the liner 44. The front and rear holding systems 46, 48 have a shape generally corresponding to an exterior shape of the chamois pad 50. In one embodiment, the systems 46, 48 have a generally curvilinear shape. The front and rear holding systems 46, 48 beneficially keep the removable chamois pad 50 stable and prevent unintended and inadvertent movement of the removable chamois pad 50. Additionally, the different shape of the front system 46 compared to the rear system 48 is beneficial to help a user identify the proper orientation of the removable chamois pad 50.

Figure 14:
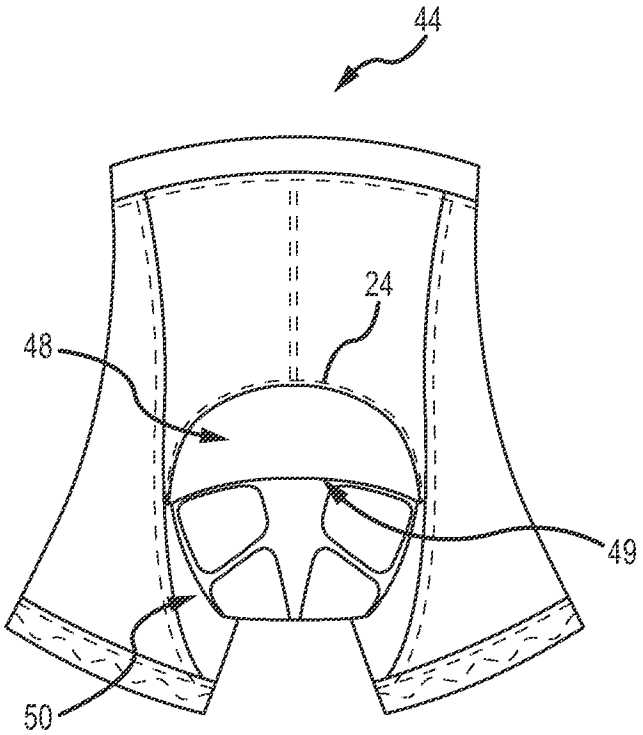
FIG. 14 is a rear perspective view of the liner of FIG. 6 when turned inside out and releasably holding the chamois of FIG. 11.
Figure 13:
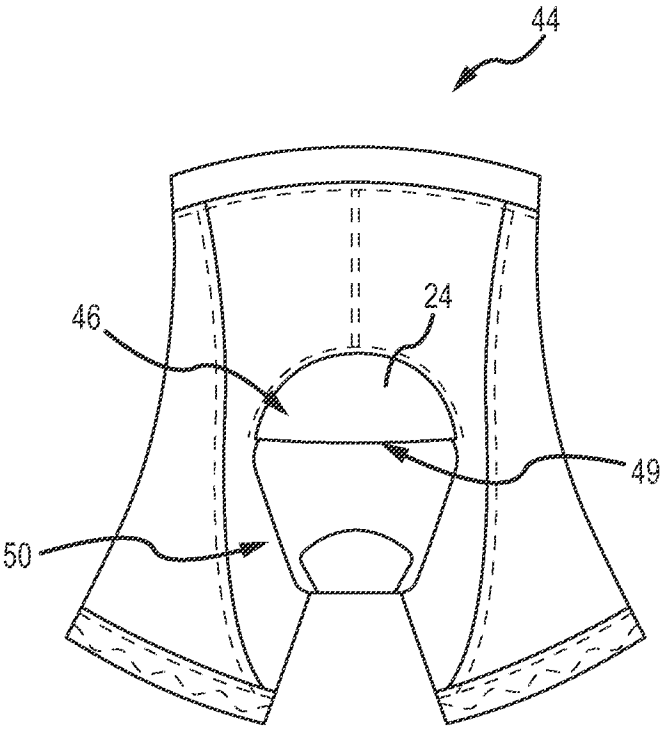
FIG. 13 is a front perspective view of the liner of FIG. 6 when turned inside out and releasably holding the chamois of FIG. 11.

In the embodiment illustrated in FIGS. 9-10, the front and rear holding systems 46, 48 generally comprise pockets with fabric interconnected to an interior surface of the liner 44 by a seam 24. The seam 24 is positioned proximate to the waist portion 8 such that openings 49 of systems 46, 48 face substantially downwardly toward the hems 14. The systems 46, 48 are positioned at the front 39 and back 41 of the liner 44 where the removable chamois pad 50 is to be worn. Once the removable chamois pad 50 is placed in its proper position, the fabric of front and rear holding systems 46, 48 holds the removable chamois pad 50 in place by overlapping at least a portion of the front end 52 and the rear end 54 of the removable chamois pad 50, as illustrated in FIGS. 13-14. Additionally or alternatively, the holding system 46, 48 may also include fabric positioned to cover at least some portion of the longitudinal sides 56 of the removable chamois pad 50, a combination of sides 56 and ends 52, 54, or substantially the entire removable chamois pad 50.

Figure 23:
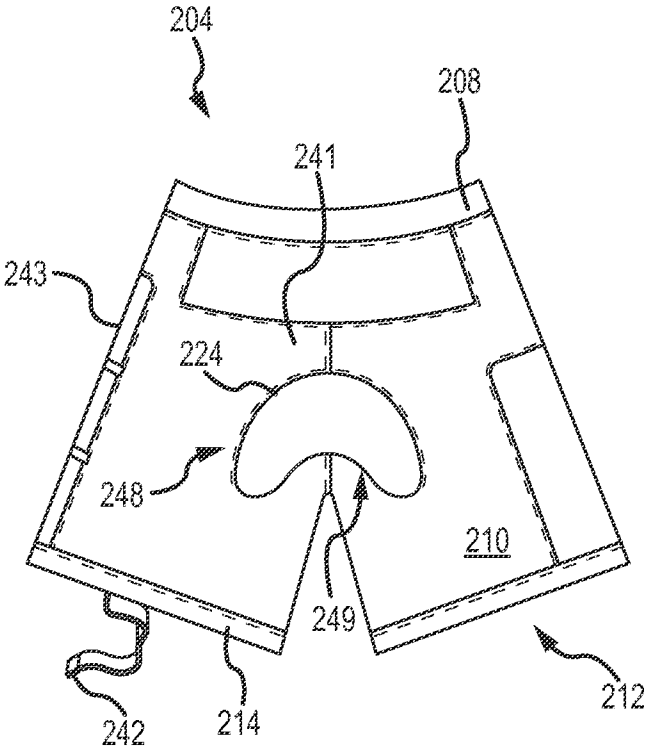
FIG. 23 is a rear perspective view of the shorts of FIG. 17 when turned inside out and illustrating a rear holding system for a removable chamois pad.
Figure 22:
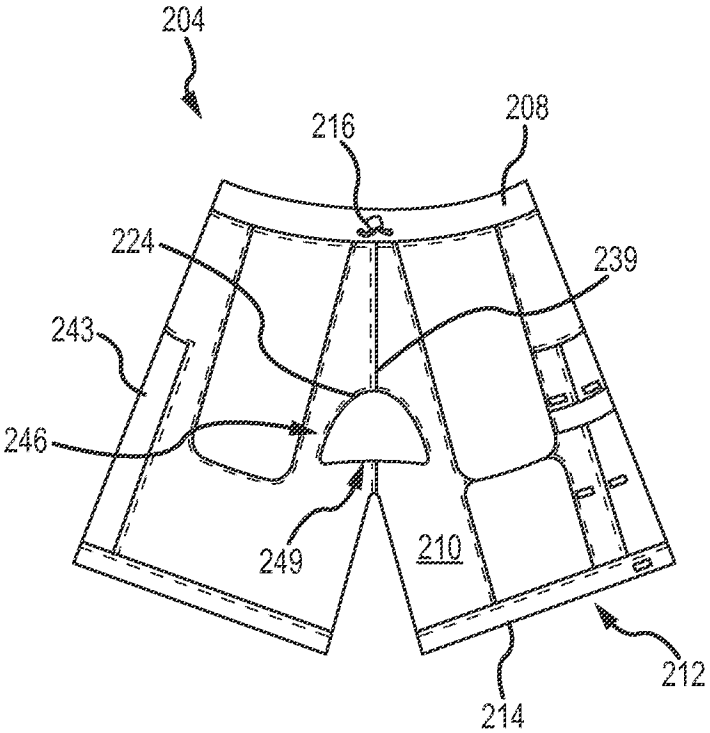
FIG. 22 is a front perspective view of the shorts of FIG. 17 when turned inside out and illustrating a front holding system for a removable chamois pad.

It will be appreciated by those of skill in the art that holding system 46, 48 may be comprised of any means adapted to releasably secure the removable chamois pad 50 to the interior of the liner 44 or directly to the clothing utilizing the closure system. For example, in one embodiment, the pad 50 includes an attachment system 58, illustrated in FIG. 12, that releasably interconnects the removable chamois pad 50 to a corresponding attachment system of the liner 44 or the shorts 4. In the embodiment illustrated in FIG. 12, the attachment system 58 is comprised of a hook and loop material. However, one of skill in the art will appreciate that the attachment system 58 may be comprised of buttons, one or more zippers, snaps, magnets, adhesives, and/or laces. Additionally, the holding systems 46, 48 may include one or more types of holding means used in combination with each other or by themselves as well as in combination with the fabric that overlaps at least a portion of the removable chamois pad 50. Optionally, the removable chamois pad 50 may be sewn into an interior of the liner 44 or the shorts 4. Additionally or alternatively, the shorts 4 may include a front holding system and a rear holding system for a removable chamois pad 50 the same as or similar to front and rear holding systems 46, 48, as described below in conjunction with FIGS. 22-23.

The shorts 4 and/or the liner 44 may also have one or more holding systems 46, 48 in one or more locations to releasably retain pads of other shapes and sizes adapted for other activities. For example, in one embodiment, the holding systems 46, 48 are positioned to releasably retain a pad positioned on an interior surface of one or more of a hip, a front portion 39 of a leg, a side portion 43 of a leg, and/or a rear portion 41 of a leg of the shorts 4 and/or the liner 44.

Figure 16:
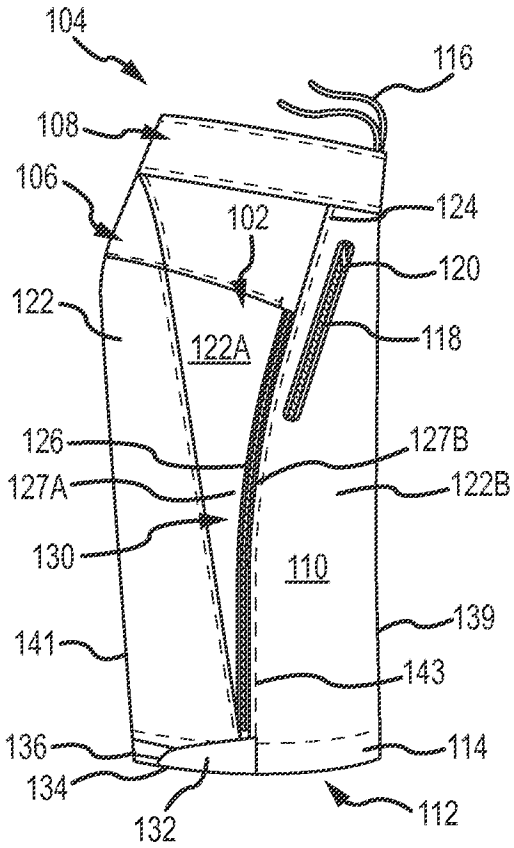
FIG. 16 is a left side elevation view of the pair of shorts of FIG. 15 with the system in a second configuration comprising a tight fit.
Figure 15:
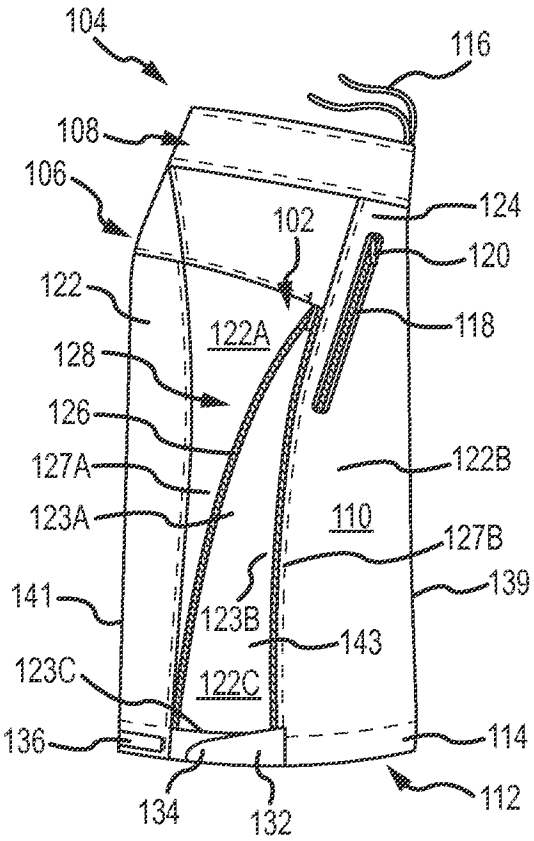
FIG. 15 is a left side elevation view of a pair of shorts with a system to adjust the fit of the shorts according to another embodiment of the present invention with the system in a first configuration comprising a loose fit.

Referring now to FIGS. 15 and 16, a system 102 to selectively adjust the fit of clothing according to another embodiment of the present invention is illustrated. System 102 is similar to the system 2 illustrated in FIGS. 1-4, but a closure 126 has a different shape compared to closure 26. The system 102 is illustrated in a first loose configuration 128 in FIG. 15 and in a second tighter configuration 130 in FIG. 16.

Referring now to FIGS. 17-20, a system 202 to selectively adjust the fit of clothing according to still another embodiment of the present invention is illustrated. More specifically, in the embodiment illustrated in FIGS. 17-20, system 202 comprises at least one of a first panel 222A interconnected to a third panel 222C by a seam 224A. At least one of a second panel 222B is interconnected to a third panel 222C by a seam 224B. System 202 also includes a first closure 226A and a second closure 226B adapted to decrease a circumference of at least a leg portion 210 of the short 204 by drawing the first and second panels 222A, 222B closer together. In one embodiment of the present invention, the third panel 222C has four sides with a generally trapezoidal shape, although the third panel may have any shape and number of sides.

The first closure 226A comprises a stretchable draw-cord 233 with a lockable slide 229 at a free end. Fixed ends (not illustrated) of the draw-cord 233 are interconnected to seams 224A, 224B within the interior of the short 204 and pass through a least one aperture 225 in the third panel 222C. The second closure 226B comprises a zipper. In one embodiment, a first portion 227A of the zipper 226B at least partially aligned with the first seam 224A and a second portion 227B of the zipper at least partially aligned with the second seam 224B. Although the first closure 226A comprises a stretchable draw-cord and the second closure 226B comprises a zipper, it will be appreciated by one of skill in the art the any type of closure may be used for either the first or second closure 226A, 226B.

Figure 18:
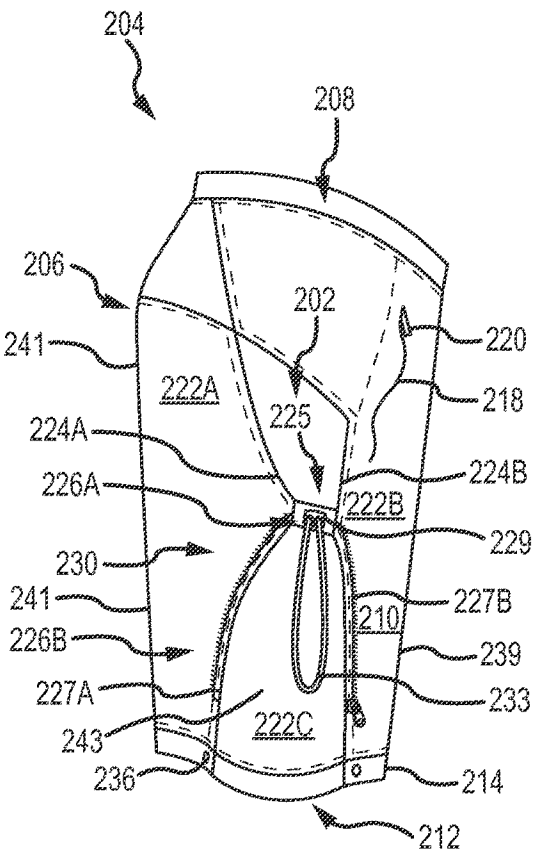
FIG. 18 is a left side elevation view of the pair of shorts of FIG. 17 with the system in a second configuration comprising a tight fit.
Figure 17:
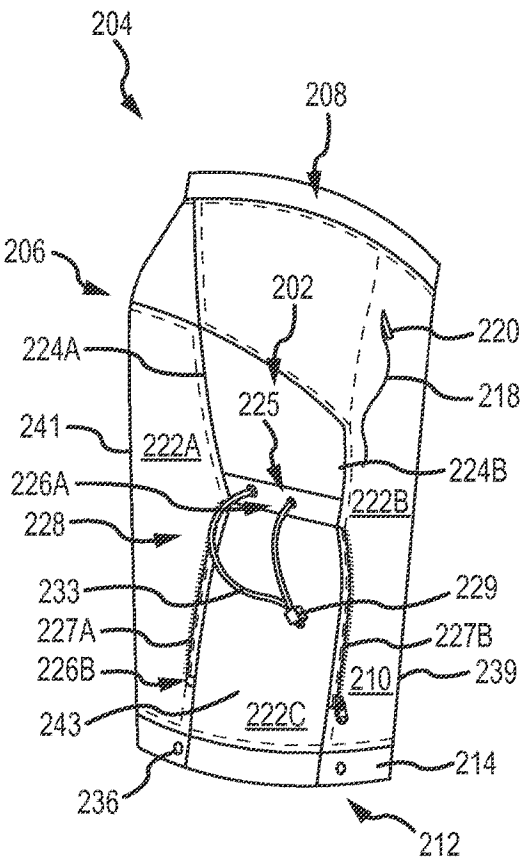
FIG. 17 is a left side elevation view of a pair of shorts with still another embodiment of a system of the present invention to adjust the fit of the shorts and showing the system in a first configuration comprising a loose fit.

In operation, the first closure 226A and the second closure 226B of system 202 may each be used independently or together to change the configuration of the system 202 from a first configuration 228 to a second configuration 230 or a third configuration 231. For example, FIG. 18 illustrates using the first closure 226A to change the system 202 to the second configuration 230. The draw-cord 233 of the first closure 226A has been pulled outwardly through apertures 225 pulling the first panel 222A and first seam 224A closer to the second panel 222B and the second seam 224B, at least partially decreasing the circumference of a portion of the leg 210. The slide 229 has been moved proximate the apertures 225 to prevent the draw-cord 233 of the first closure 226A from moving back through the apertures 225. In one embodiment of the present invention, when the system 202 is in the second configuration 230, at least a portion of the third panel 222C is visible and forms a portion of the exterior surface of the article of clothing 204.

Figure 20:
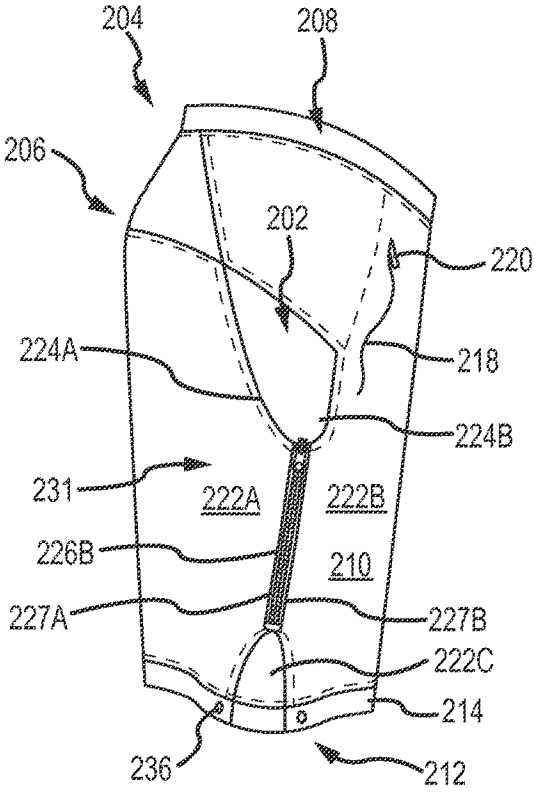
FIG. 20 is a left side elevation view of the pair of shorts of FIG. 17 with the system in the third configuration.
Figure 19:
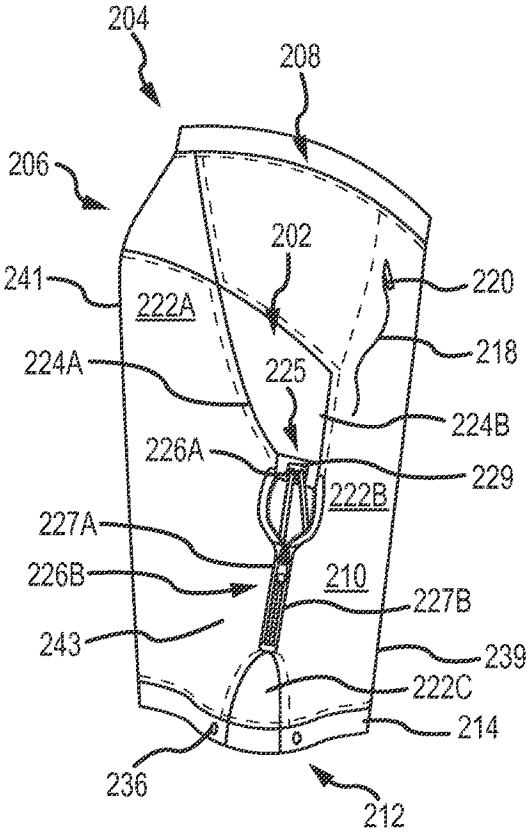
FIG. 19 is a left side elevation view of the pair of shorts of FIG. 17 with the system transitioning to a third configuration.

The second closure 226B may be used to change the system 202 to the third configuration 231. As illustrated in FIGS. 19-20, the zipper of the second closure 226B is operable to draw the first panel 222A and first seam 224A closer to the second panel 222B and the second seam 224B. In this manner, the circumference of at least a portion of the leg 210 is at least partially decreased. The second closure 226B may also have a length selected to at least partially hide the first closure 226A when the second closure 226B is in the closed configuration, as illustrated in FIG. 20. In another embodiment, when the system 202 is in the third configuration 231, no portion of the third panel 222C is visible from the exterior of the article of clothing 204.

Although the second closure 226B is illustrated interconnected to only a portion of the first and second seams 224A, 224B, it will be understood by one of skill in the art that the length of the zipper of the second closure 226B may be increased to be substantially equal to the lengths of seams 224A, 224B similar to closures 26 and 126 described above. In one embodiment, the second closure extends to the hem portion 214. In addition, although the second closure 22B is shown aligned to close in an upward direction, other arrangements of the second closure 22B are contemplated. Accordingly, in one embodiment, the second closure 22B is aligned to close in a downward direction, similar to closures 26, 126.

The system 202 may include a tab the same as or similar to tab 32 which has been removed for clarity in FIGS. 17-20. A free end of the tab may be releasably interconnected to shorts 204 at one or more attachment points 236. In system 202, the attachment points 236 are illustrated as snaps, however, any type of attachment may be used with the system of the present invention.

Figure 21:
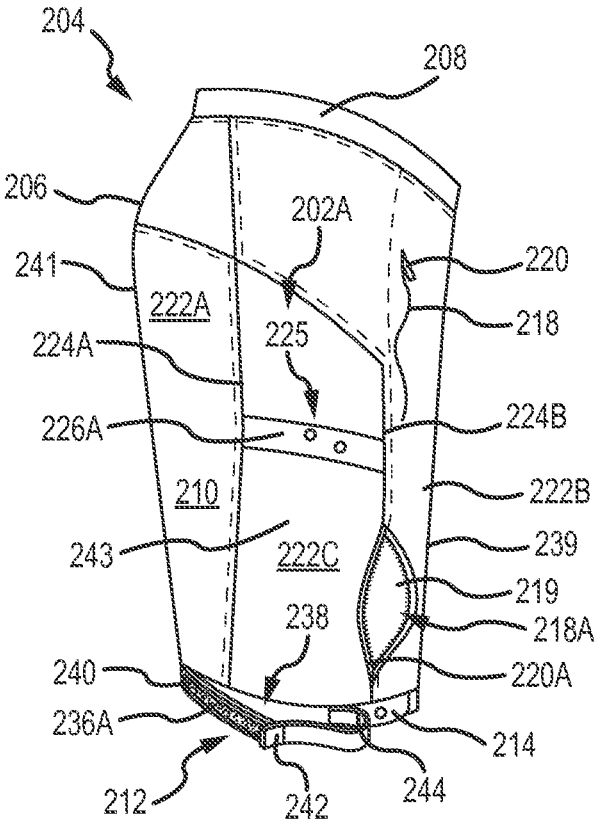
FIG. 21 is a left side elevation view of a pair of shorts with a system to adjust the fit of the shorts according to another embodiment of the present invention.

Referring now to FIG. 21, additionally or alternatively the system 202A may include a strap 238 with a fixed end 240 interconnected to a portion of the hem 214. A free end 242 of the strap 238 is moveably interconnected to a second portion of the hem 214 by a retaining element 244, such as a loop. Attachment elements 236A are positioned on the strap 238. In the embodiment illustrated in FIG. 21, the attachment elements 236A comprise a hook and loop closure interconnected to opposing surfaces of the strap 238. In operation, the free end 242 of the strap 238 may be pulled further through the retaining element 244 to decrease the circumference and tighten the fit of at least a portion of the hem 214.

The system 202A may further comprise a pocket 218A positioned between one or more of the first and second panels 222A, 222B and the third panel 222C. The pocket 218A comprises a liner 219 interconnected to the second and third panels 222B, 222C. The pocket 218A may optionally include a closure 220A, such as a zipper. In operation, when the first and second closures 226, 226B (which have been removed in FIG. 21 for clarity) are in the open position and the system 202A is in the first or second configurations 228, 230, the pocket 218A is accessible. However, when the system 202A is in the third configuration 231, an opening of the pocket 218A is at least partially covered by the second closure 226B and/or the first and second seams 224A, 224B. In this manner, the pocket 218A may be hidden to prevent inadvertent or unintended loss and increased security for articles placed in the pocket 218A. In one embodiment of the present invention, the pocket 218A may be adapted to provide ventilation within the shorts 204. For example, in one embodiment, the opening of the pocket 218A may be positioned to face the front portion 239 of the shorts to catch wind as the wearer moves forward. In one embodiment, the liner 219 of the pocket forms a path or duct to direct air to a predetermined area within the shorts. Accordingly, in one embodiment of the present invention, the liner 219 comprises a tube with one opening proximate to the closure 22A and a second opening facing an interior portion of the shorts 204. In another embodiment, the pocket 218A does not include the liner 219 and the pocket 218A forms an aperture through the shorts 204. The wearer can adjust the amount of ventilation provided by the pocket 218A by opening, closing, or changing the position of closure 220A and/or closure 226B.

As previously described, shorts of all embodiments of the present invention may include a front and rear holding system 246, 248 for a removable chamois pad 50. More specifically, and referring now to FIGS. 22-23 where the shorts 204 are illustrated turned inside out for clarity, the shorts 204 may include a front holding system 246 and a rear holding system 248 to removably hold a removable chamois pad 50. The holding systems 246, 248 may be the same as, or similar to, the holding systems 46, 48 described above in conjunction with FIGS. 9-14.

Figure 25:
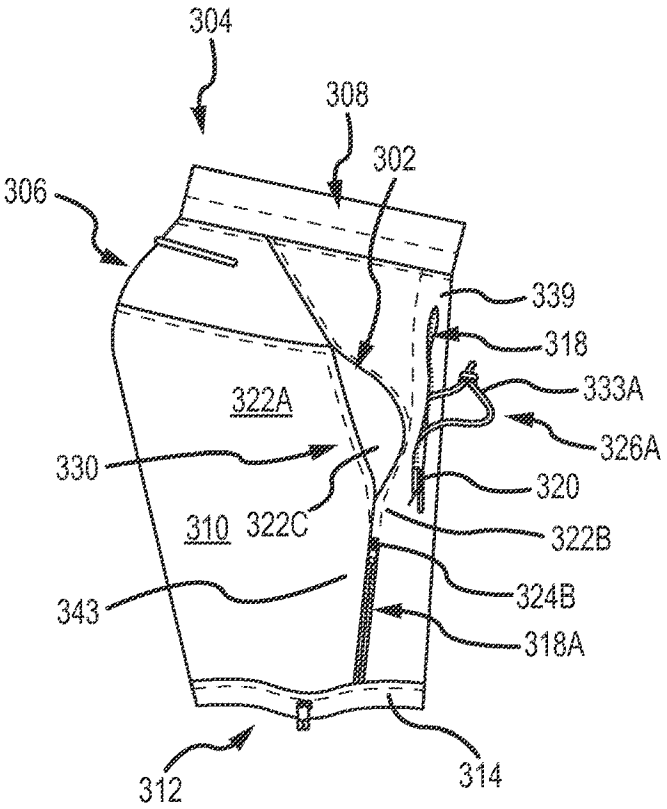
FIG. 25 is a left side elevation view of the pair of shorts of FIG. 24 with the system in a second configuration.
Figure 24:
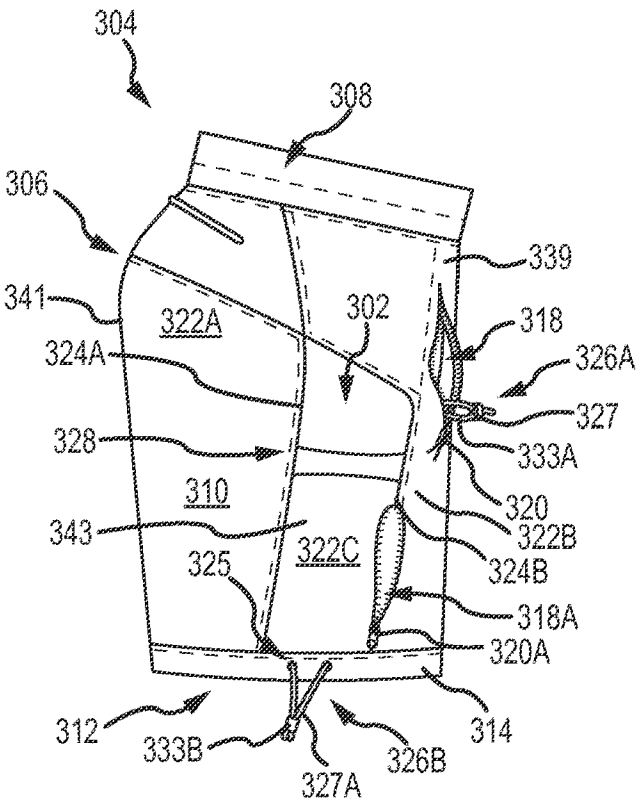
FIG. 24 is a left side elevation view of a pair of shorts illustrating yet another embodiment of a system of the present invention to adjust the fit of the shorts with the system illustrated in a first configuration.
Figure 26:
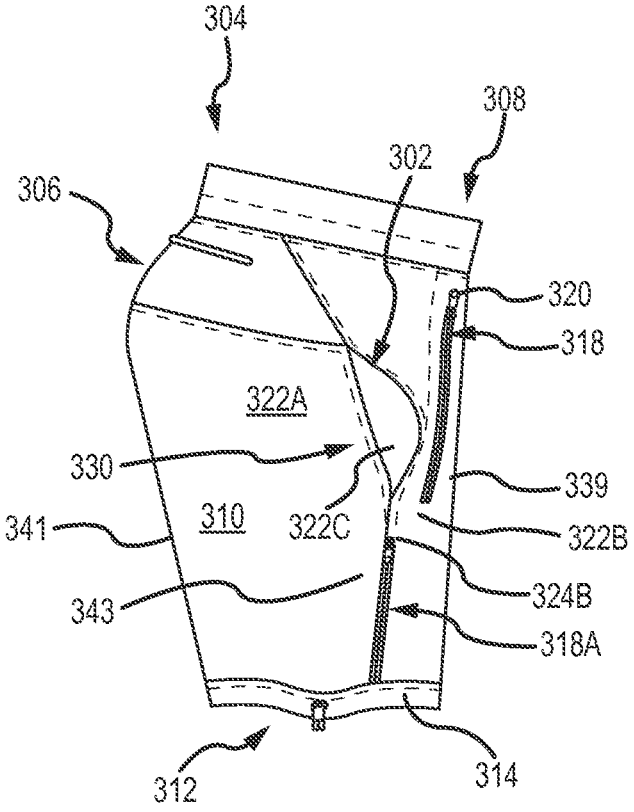
FIG. 26 is a left side elevation view of the pair of shorts of FIG. 25 with a closure of a pocket in a closed configuration.

Referring now to FIGS. 24-26, yet another embodiment of a system 302 of the present invention is illustrated. System 302 includes a first closure 326A comprising a draw-cord 333A. A free end of the draw-cord 333A is accessed from within an interior of a pocket 318. The free end of the draw-cord 333A of the first closure 326A is illustrated pulled at least partially out of the pocket 318 for clarity in FIG. 24. However, one of skill in the art will recognize that the free end may be positioned within, and be accessible from, the interior of the pocket 318. A stop mechanism 327 is positioned on the draw-cord 333A. In the embodiment of the present invention illustrated in FIG. 24, the stop mechanism 227 is a lockable draw-cord slide. However, one of skill in the art will appreciate that other stop mechanisms may be used to prevent inadvertent or unintended movement of the draw-cord 333A. Fixed ends (not illustrated) of the draw-cord of the first closure 326A are interconnected at one or more points to the first and second seams 324A, 324B within an interior of the shorts.

System 302 may also include a second closure 326B. In one embodiment, the second closure 326B is proximate to the hem 314. In one embodiment of the present invention, the second closure 326B comprises a draw-cord 333B that at least partially wraps axially around the leg portion 310. A free end of the draw-cord 333B extends from apertures 325. A lock mechanism 327, such as a lockable slide, is positioned on the draw-cord. Fixed ends (not illustrated) of the draw-cord are interconnected to at least two points of the leg portion 310.

The system 302 may further comprise a pocket 318A similar to pocket 218A described above in conjunction with FIG. 21. Pocket 318A is positioned between one or more of the first and second panels 322A, 322B and the third panel 322C and is accessible when the system 302 is in the first configuration 328, or loose fit configuration, as illustrated in FIG. 24.

In operation, to adjust the fit of the shorts 304, the wearer pulls the free end of one or more of the draw-cords 333 of the first and second closures 326A, 326B to move the system 302 from the first configuration 328 to the second configuration 330, illustrated in FIG. 25. More specifically, and referring now to FIGS. 25-26, the free end of the first closure 326A has been pulled away from the pocket 318, drawing at least a portion of the first and second panels 322A, 322B closer together to at least partially decrease a circumference of a portion of the leg portion 310 of the shorts 304. Additionally, the free end of the second closure 326B (not visible) has been pulled to at least partially decrease a circumference of a portion of the leg portion 310 proximate the hem 314. In one embodiment, when at least one of the first and second draw-cords 333A, 333B are pulled away from the shorts 304 to decrease the circumference of the leg, the third panel 322C is at least partially hidden from view by the first and second panels 322A, 322B. In another embodiment, pulling the free ends of draw-cords 333A, 333B draws panels 322A, 322B to completely hide the third panel 322C from view from the exterior of the article of clothing 304. In still another embodiment, at least a portion of the third panel 322C is visible when the draw-cords 333A, 333B are pulled away from the shorts 304.

FIG. 26 shows the shorts 304 after closure 320 associated with pocket 318 has been moved to a closed position, thereby hiding the free end of the draw-cord 333A of the first closure 326A within the pocket 318. Additionally, in the second configuration 330, at least a portion of the pocket 318A is hidden by the first and second panels 322A, 322B. Although not illustrated, the shorts 304 may include a tab proximate to the hem 314 as previously described.

Figure 28:
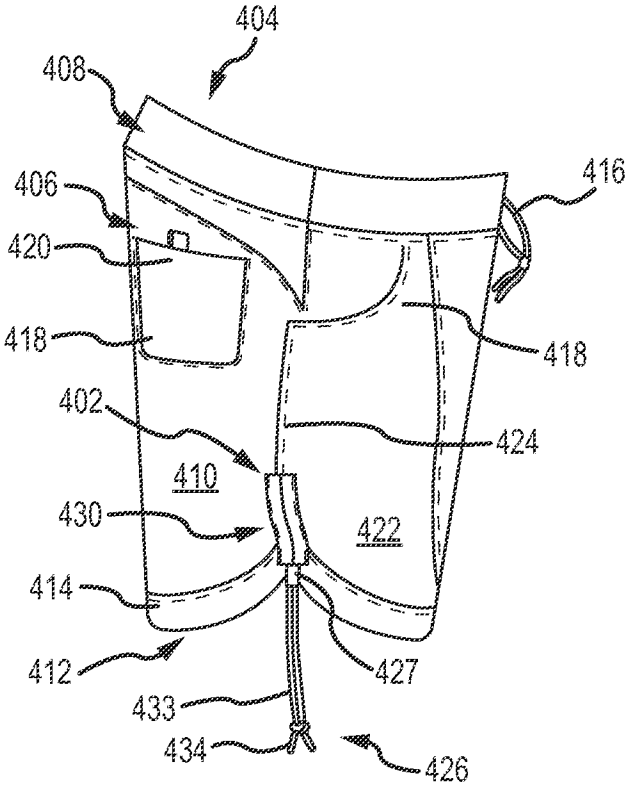
FIG. 28 is a left side elevation view of the shorts of FIG. 27 with the system in a second configuration.
Figure 27:
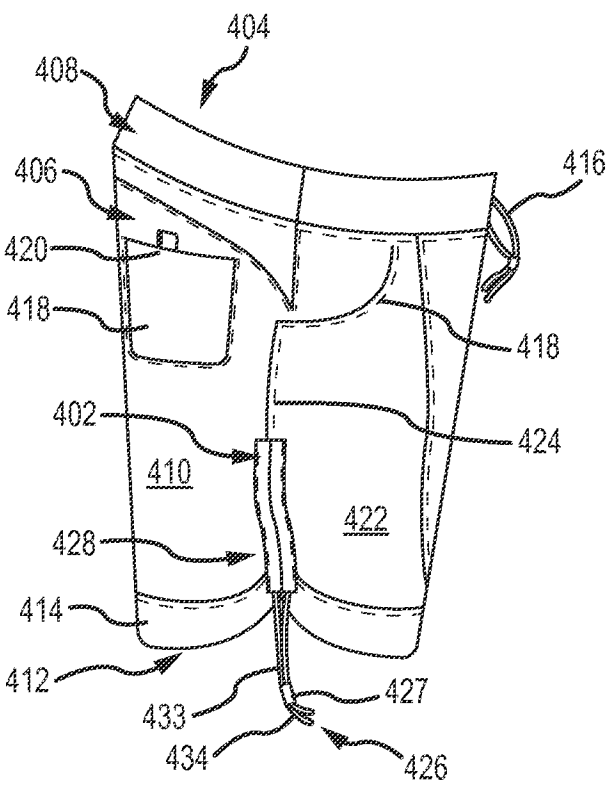
FIG. 27 is a left side elevation view of a pair of shorts with yet another embodiment of the system of the present invention to adjust the fit of the shorts with the system in a first configuration.

Referring now to FIGS. 27-28, still another embodiment of a system 402 of the present invention for adjusting the fit of a garment 404 is illustrated. The system 402 comprises a ruching closure 426 operable to draw or gather fabric of one or more panels 422 of the garment 404. The ruching closure 426 comprises a draw-cord 433 with a free end 434 and a stop mechanism 427, such as a lockable slide known to those of skill in the art. One or more fixed ends (not illustrated) of the draw-cord 433 are interconnected to the one or more panels 422 within an interior of the article of clothing. In one embodiment, the draw-cord 433 comprises at least two fixed ends interconnected to at least two different portions of the garment 404. The free end 434 extends through an aperture to an exterior of the article of clothing. In one embodiment, the aperture includes a grommet, similar to aperture 325 described above. In one embodiment, the garment 404 comprises a pair of shorts. In another embodiment, the garment comprises a skirt or a skort.

In operation, a wearer may adjust the fit of the shorts 404 by moving the system 402 from a first configuration 428 to a second configuration 430 by one or more of pulling the draw-cord free end 434 and moving the stop mechanism 427. In one embodiment, the fixed ends of the draw-cord are interconnected to a panel proximate to the waist portion 408 of the garment. The user may pull the free end and move the stop 427 upwardly against the hem 414 to adjust the fit of the clothing, as illustrated in one embodiment in FIG. 28. As the stop mechanism 427 pushes the hem 414, at least a portion of one or more panels 422 is gathered together to adjust the fit of the shorts 404. After the stop mechanism 427 is pushed up, the stop mechanism 427 grips the draw-cord 433 to prevent release of the gathered fabric of the one or more panels 422. In the embodiment of the system 402 of the present invention illustrated in FIGS. 27-28, the shorts 404 have a hem 414 that hangs lower in the first configuration 428 compared to the position of the hem 414 in the second configuration 430.

Although the ruching closure 426 of system 402 is oriented substantially vertically proximate seam 424 in the embodiment of the present invention illustrated in FIGS. 27-28, one of skill in the art will recognize that the ruching closure 426 may have any desired orientation, including a generally horizontal orientation. In one embodiment, the free end 434 of the closure 426 is positioned proximate to the waist portion 408 of the shorts 404 and the fixed ends of the draw-cord 433 are interconnected to the one or more panels 422 proximate to the hem 414. In this embodiment, as the free end 434 of the draw-cord 433 is pulled upwardly, away from the shorts 404, the fixed ends pull at least a portion of the panels 422 upwardly toward the waist portion 408. Optionally, the cord free end 434 may be accessible from within pocket 418 of the shorts 404. Thus, the free end 434 may be accessed or hidden by the pocket, similar to draw-cord 333A illustrated in FIGS. 24-26. Further, the system 402 may be used in conjunction with any other system 2, 102, 202, 302 of the present invention to enable the wearer to adjust both the fit of the hem 414 as well as the circumference of the leg portion 410.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A system for selectively adjusting a fit of an article of clothing, the system comprising:

a closure interconnected to a first portion and a second portion of the article of clothing;

a third portion of the article of clothing positioned between the first and second portions, wherein, when the closure is in an open position, the system is in a first configuration and the third portion maintains a spaced relationship between the first and second portions, wherein when the closure is in a closed position, the system is in a second configuration, and wherein at least a portion of the article of clothing has a tighter fit in the second configuration than in the first configuration;

wherein at least one of the first portion, the second portion, and the third portion comprises a fabric panel joined by a seam to a different fabric panel of a different one of the first portion, the second portion, and a third portion, and wherein the first, second, and third portion are located in at least one of a leg portion or a sleeve portion of the article of clothing;

wherein the first portion is a first fabric panel, the second portion is a second fabric panel, and the third portion is a third fabric panel, wherein the first fabric panel is interconnected to the third fabric panel by a seam and the second fabric panel is interconnected to the third fabric panel by a seam; and wherein the article of clothing has a leg or sleeve opening, the opening having a first circumference when the closure is in an open position, and having a second circumference when the closure is in a closed position.

2. The system of claim 1, wherein the closure is at least one of a zipper, a double zipper, a hook and loop material, a tab, a magnet, a ziplock, ruching, a bungee, lacing, a Boa, a button, a snap, a draw-cord, and a camlock, and wherein the closure is positioned in at least one of an arm or sleeve, a back, a front, a waist, or a leg of the article of clothing.

3. The system of claim 1, wherein the article of clothing comprises one of short legs and long legs, wherein the system is positioned in at least a portion of each leg of the article of clothing, and wherein a bottom portion of the third portion proximate to a bottom of each leg is wider than an upper portion of the third portion distal to the bottom of each leg.

4. The system of claim 1, wherein the system is positioned in at least one of an inner portion, an outer portion, a front portion, and a back portion of each leg of the article of clothing, and wherein, in the first configuration, the third portion forms a portion of an exterior surface of the article of clothing, and, in the second configuration, the third portion is not visible from an exterior of the article of clothing.

5. The system of claim 1, wherein a first edge of the third portion is interconnected to the first portion along a length of the closure, a second edge of the third portion is interconnected to the second portion along the length of closure, and a third edge of the third portion is oriented in a different direction than the first and second edges, wherein the third edge is positioned between the first and second edges proximate a bottom portion of the article of clothing.

6. The system of claim 5, wherein the first edge and the second edge are of approximately the same length, and wherein the first edge of the third portion is not parallel to the second edge of the third portion.

7. The system of claim 1, wherein in the first configuration of the system, a circumference of at least a portion the article of clothing has a first dimension and the article of clothing has a loose fit, and wherein in the second configuration of the system, the circumference of the at least a portion of the article of clothing has a second dimension that is less than the first dimension and the article of clothing has a tighter fit.

8. The system of claim 1, wherein the fabric panel of the at least one of the first portion, the second portion, and the third portion is formed of at least one of a fabric type and a fabric color that is different than a fabric type or a fabric color of the different fabric panel.

9. The system of claim 1, wherein a type of fabric of at least one of the first, second, and third portions is selected to change a rate of ventilation provided in the first configuration compared to the second configuration.

10. The system of claim 1, wherein a type of fabric of at least one of the first, second, and third portions is selected to change an amount of wind proofing provided in the first configuration compared to the second configuration.

11. The system of claim 1, wherein one of the first, second, and third portions comprises one of a water proof fabric and a water resistant fabric, and wherein the system provides a different amount of protection from moisture in the first configuration compared to the second configuration.

12. The system of claim 1, wherein a type of fabric of at least one of the first, second, and third portions is selected to change a rate of flexibility and/or stability as well as control blood flow provided in the first configuration compared to the second configuration.

13. The system of claim 1, wherein a type of fabric of at least one of the first, second, and third portions is selected to change a rate of buoyancy provided in the first configuration compared to the second configuration.

14. The system of claim 1, wherein a type of fabric of at least one of the first, second, and third portions is selected to increase visibility of the article of clothing when the system is in one of the first and the second configurations.

15. The system of claim 1, further comprising at least one holding system adapted to releasably secure a chamois pad or removable chamois pad within an interior of the article of clothing.

16. The system of claim 1, further comprising at least one pocket that is accessible when the system is in one of the first and second configurations and that is inaccessible when the system is in the other of the first and second configurations.

* * * * *